US009140016B2

(12) United States Patent
Habodasz

(10) Patent No.: US 9,140,016 B2
(45) Date of Patent: Sep. 22, 2015

(54) MODULAR COVER FOR SUPPORT COLUMN

(71) Applicant: Anthony P. Habodasz, Troy, OH (US)

(72) Inventor: Anthony P. Habodasz, Troy, OH (US)

( * ) Notice: Subject to any disclaimer, the term of this patent is extended or adjusted under 35 U.S.C. 154(b) by 0 days.

(21) Appl. No.: 14/143,974

(22) Filed: Dec. 30, 2013

(65) Prior Publication Data

US 2014/0182226 A1 Jul. 3, 2014

Related U.S. Application Data

(60) Provisional application No. 61/747,635, filed on Dec. 31, 2012, provisional application No. 61/913,618, filed on Dec. 9, 2013.

(51) Int. Cl.
*E04F 13/073* (2006.01)
*E04F 13/18* (2006.01)

(52) U.S. Cl.
CPC ..... *E04F 13/0736* (2013.01); *E04F 13/185* (2013.01)

(58) Field of Classification Search
CPC ..... E04F 13/07; E04F 13/072; E04F 13/073; E04F 13/0736
USPC ..... 52/20, 170, 245, 223.5, 107, 588.1, 52/834, 835, 843, 844, 845
See application file for complete search history.

(56) References Cited

U.S. PATENT DOCUMENTS

| | | | | |
|---|---|---|---|---|
| 3,672,103 | A * | 6/1972 | Kost | 52/20 |
| 3,974,599 | A * | 8/1976 | Grosh | 52/20 |
| 4,019,301 | A | 4/1977 | Fox | |
| 4,089,139 | A * | 5/1978 | Moffa et al. | 52/20 |
| 5,608,998 | A * | 3/1997 | Hume | 52/245 |
| 6,484,451 | B1 * | 11/2002 | Gavin | 52/20 |
| 6,519,909 | B1 | 2/2003 | Fawley | |
| 8,245,452 | B2 * | 8/2012 | Koteskey | 52/19 |
| 8,322,114 | B2 * | 12/2012 | Waters et al. | 52/834 |
| 2005/0268564 | A1 * | 12/2005 | Theophilus | 52/107 |
| 2008/0000192 | A1 | 1/2008 | McGlinch | |
| 2010/0223882 | A1 | 9/2010 | Parenti et al. | |

FOREIGN PATENT DOCUMENTS

JP 11-071856 A 3/1999

* cited by examiner

*Primary Examiner* — Rodney Mintz
*Assistant Examiner* — Adam Barlow
(74) *Attorney, Agent, or Firm* — Mattingly & Malur, PC

(57) ABSTRACT

A cover is provided in modular form for covering support structures, including columns supporting overpasses on roadways. The cover is formed of cover segments that are connected together laterally and vertically. The cover segments are provided with multiple techniques for vertical and horizontal connection, air channels, stand offs, worker viewing areas, and drainage spaces. The cover is made of a lightweight material and allows for tolerance for expansion of the support structure material.

28 Claims, 30 Drawing Sheets

FIG. 32A
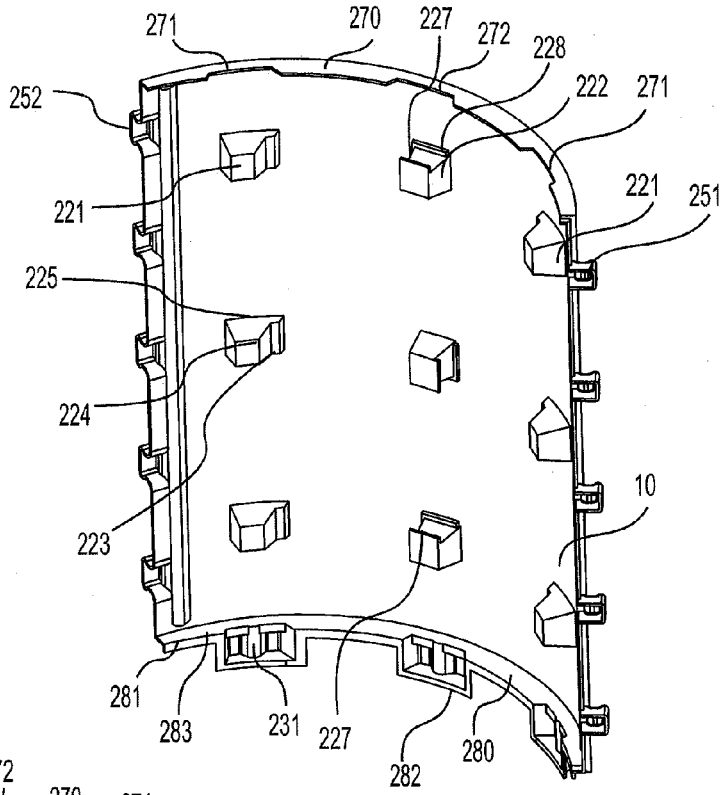
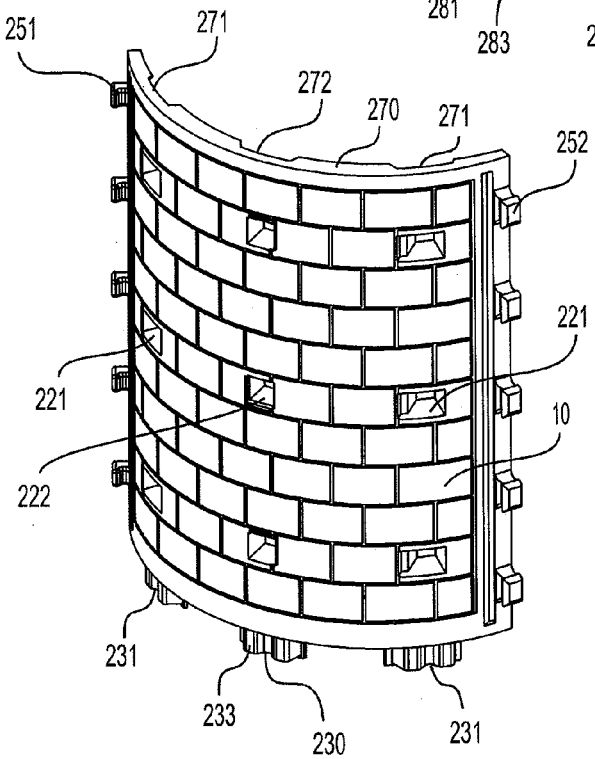
FIG. 32B

MODULAR COVER FOR SUPPORT COLUMN

This application claims the benefit of U.S. Provisional Application No. 61/747,635 filed Dec. 31, 2012, and U.S. Provisional Application No. 61/913,618 filed Dec. 9, 2013.

FIELD OF THE INVENTION

The invention relates to a modular cover for support structures having multiple cover segments connected together using multiple connection techniques.

BACKGROUND OF THE INVENTION

Covers for support structures, such as columns, include sleeves, shields, and wraps that cover the support structure. The covers are for protecting a support structure of, for example, a bridge or an overpass commonly located along roadways.

In areas where snow and ice accumulate, and the snow is removed from the road by a snow plow or other snow removal device, road salts, chemicals, and other materials incidentally adhere to the support columns along the road. In many instances, the support structures are made of concrete. As a result, erosion and deterioration of the supports occurs necessitating major repair, which is costly.

One preventative measure available to inhibit corrosion of the concrete support is supplied by routine painting of the supports. However, painting is expensive, poses a safety risk to workers, and disrupts traffic in areas where the maintenance is taking place. Also, the paint only lasts for a short period of time. Accordingly, the painting process only assists in the preventative maintenance, and becomes a continuous/recurring procedure.

SUMMARY OF THE INVENTION

The modular cover for support structures having multiple cover segments according to embodiments of the invention prevents the deterioration of the support structure while protecting it from the elements and chemicals mixed into precipitation. In particular, the invention is directed to the prevention of concrete spalling due to snow and chemicals (e.g., road salts) adhering to the surface of the concrete, without affecting the structural integrity of the bridge or overpass once the cover is installed. The cover will accommodate supports of any height and any shape.

Thus, the apparatus aims to prevent catastrophic bridge failures caused by the erosion of supports. The cover prevents the support member from peeling, rotting, or absorbing water and the cover therefore becomes resistant to salt corrosion.

The cover segments when connected together are aesthetically appealing. The modular cover is easy to install, cost effective, and environmentally friendly. The cover is lightweight, may be made of recyclable/recoverable material (green technology), and reduces safety issues/hazards that normally are associated with industry standard maintenance practices, such as the painting along roadways. Upon application of the present invention, road closures would be less frequent and bridge support life cycles would be longer.

It is an object of the present invention to provide a modular cover that protects support structures from corrosion and thereby overcome the drawbacks of the prior art. Further, it is an object of the present invention to provide a modular cover made of inexpensive material that a worker may install quickly and without difficulty. It is another object of the embodiments of the invention to provide modular cover that can be molded into shapes and designs that fit multiple shapes of supports structures. It is yet another object of the present invention to provide a cover that is light-weight and durable. Another object of the present invention is to provide vertical and lateral connecting features on the cover segments that allow one cover segment of multiple cover segments connected to form a cover to be uninstalled while leaving the other cover segments of the cover installed.

It is yet another object of the present invention to provide a modular cover for surrounding a support structure, including: a plurality of cover segments modularly connected to form the cover; lateral connectors formed on opposite sides of each cover segment in the lateral direction; top grooves formed periodically into a top flange member, which extends inwardly around the top surface of each cover segment; bottom extending members extending in a downward direction along a bottom surface of each cover segment; and a plurality of contact members formed as an indentations in the outer surface of each cover segment extending inward; wherein the lateral connectors of one side of a cover segment connect to corresponding lateral connectors formed on the opposite side of another cover segment, the bottom extending members of a cover segment fit into corresponding top grooves of another cover segment when cover segments are stacked vertically to form the cover. The cover segments are formed of high density polyethylene. On one side of the cover segment the lateral connectors are formed as a protruding member extending outwardly, and on the opposite side of the cover segment, the lateral connectors are formed as an accepting member for accepting the protruding member. Further, upon connection, the lateral connectors form a mechanical connection. The lateral connectors, top flange member, and bottom extending members, are formed as one piece.

The cover segment further includes a bottom extending flange member which extends in an inward direction around the bottom surface of each cover segment, wherein the bottom extending members are formed to extend in a downward direction off of the bottom extending flange member, and upon vertical stacking of cover segments to form the cover the bottom surface of the bottom extending flange member contacts the top surface of the top flange member. The lateral connectors on one side of the cover segment are formed to have top and bottom concave surfaces, the lateral connectors on the opposite side of the cover segment are formed to have top and bottom concave surfaces and are formed to accept the lateral connectors on the one side of a cover segment, the later connectors on the one side of the cover segment and the lateral connectors on the opposite side of another cover segment connect such that a side edge of each cover segment connected is flush when connected, and a flexible fastener is used to secure the connection made between the lateral connectors, the flexible fastener is guided by the top and bottom concave surface of the lateral connector on the opposite side of the cover segment.

BRIEF DESCRIPTION OF THE DRAWINGS

FIG. 32A is a perspective view of a cover segment of the cover in FIG. 31 of an embodiment of the present invention.

FIG. 32B is another perspective view of a cover segment of the cover in FIG. 31 of an embodiment of the present invention.

DETAILED DESCRIPTION OF THE PREFERRED EMBODIMENTS

The modular cover for support structures according to embodiments of the invention has multiple cover segments connected together using multiple connection techniques. Although the examples of the uses of the modular cover or cover apparatus refer to covering support structures, which are column supports for a bridge or an overpass, the invention is not limited to that use. The cover may be adapted and modified to fit around structures of many shapes and sizes. Additionally, the cover segments of the modular cover may be injection molded, by standard plastic manufacturing process methods & materials, such as thermoforming, blow molding, compression, rotomold, and forms of injection molded processes. The cover segments are preferably made of high density polyethylene. The cover segments may be structured according to the shape of the support structure to be covered, e.g., a column of circular cross section. The present invention is not limited to any of the mold process listed above.

Figure 1:
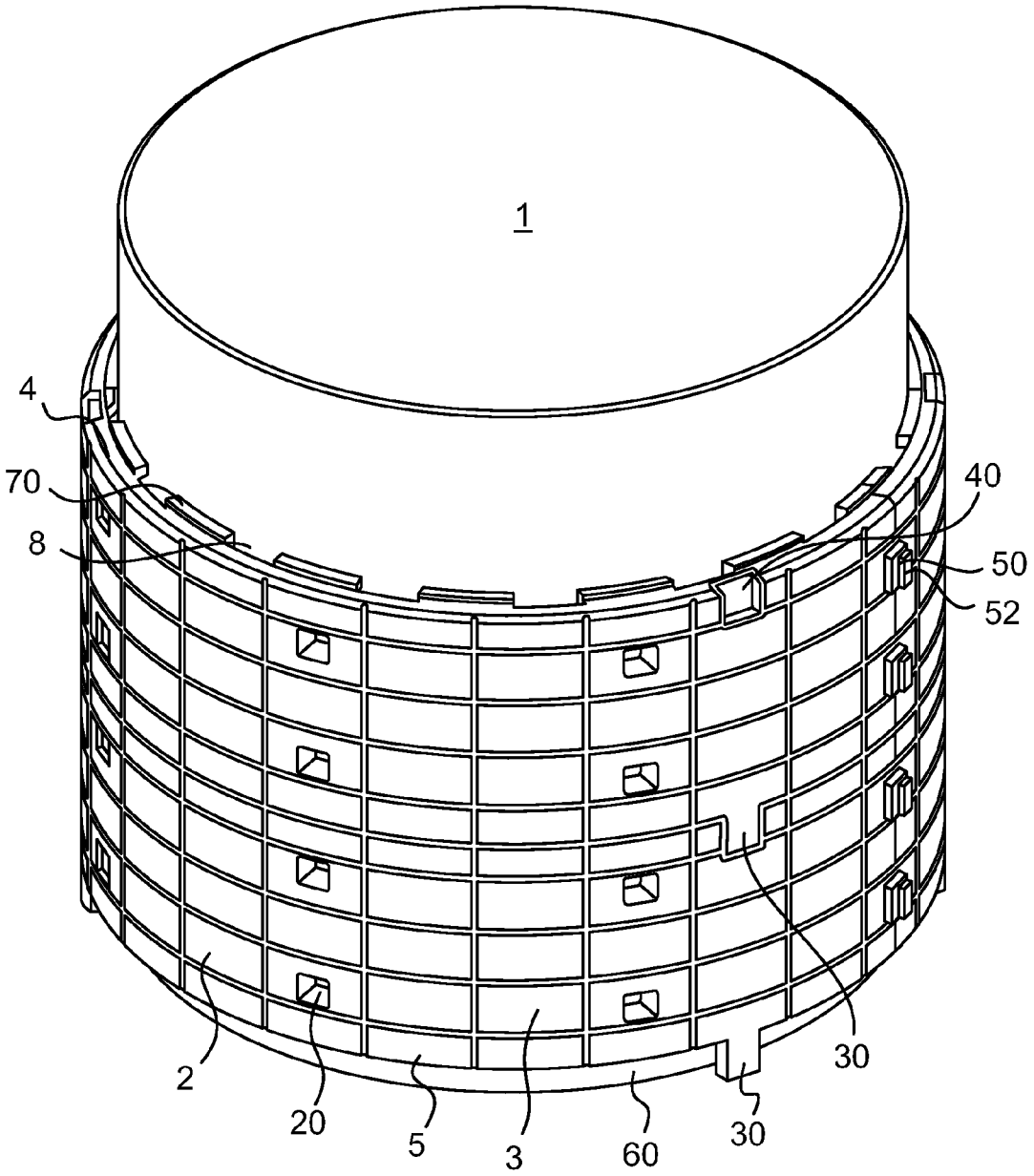
FIG. 1 is a perspective view of a cover according to an embodiment of the invention surrounding a support column

FIG. 1 shows a modular cover or cover apparatus 2 according to the first embodiment of the present invention. The cover 2 is comprised of a plurality of cover segments 10 according to the first embodiment that are connected to each other to cover a support structure 1. The support structure 1 as referred to herein is a bridge support column, pier, pillar, pole, abutment or any other component used to support an overpass or a bridge, etc. The figures show a cover 2 in a circular form configured to cover a concrete support structure 1 that has a cylindrical shape. Although the figures show the cover in a circular form to cover a structure that has a cylindrical shape, the cover segments may be manufactured to cover support structures of any shape, such as rectangular, and the shape of the cover is not limited to that shown in the figures.

The cover is modular in that segments 10 are connected laterally (horizontally) together, and also vertically together (stacked on one another) to cover a support structure in situ. Preferably, the cover segments 10 are joined laterally in one vertical layer. The vertical layer is lifted so that another vertical layer of segments 10, which have been joined laterally around the support 1, can be connected. The lifted vertical layer is then lowered onto the lower vertical layer to connect in the vertical direction. The vertical layers of the stacked modular cover 1 are able to be continued to achieve a vertical stack of a desired overall height.

Figure 2:
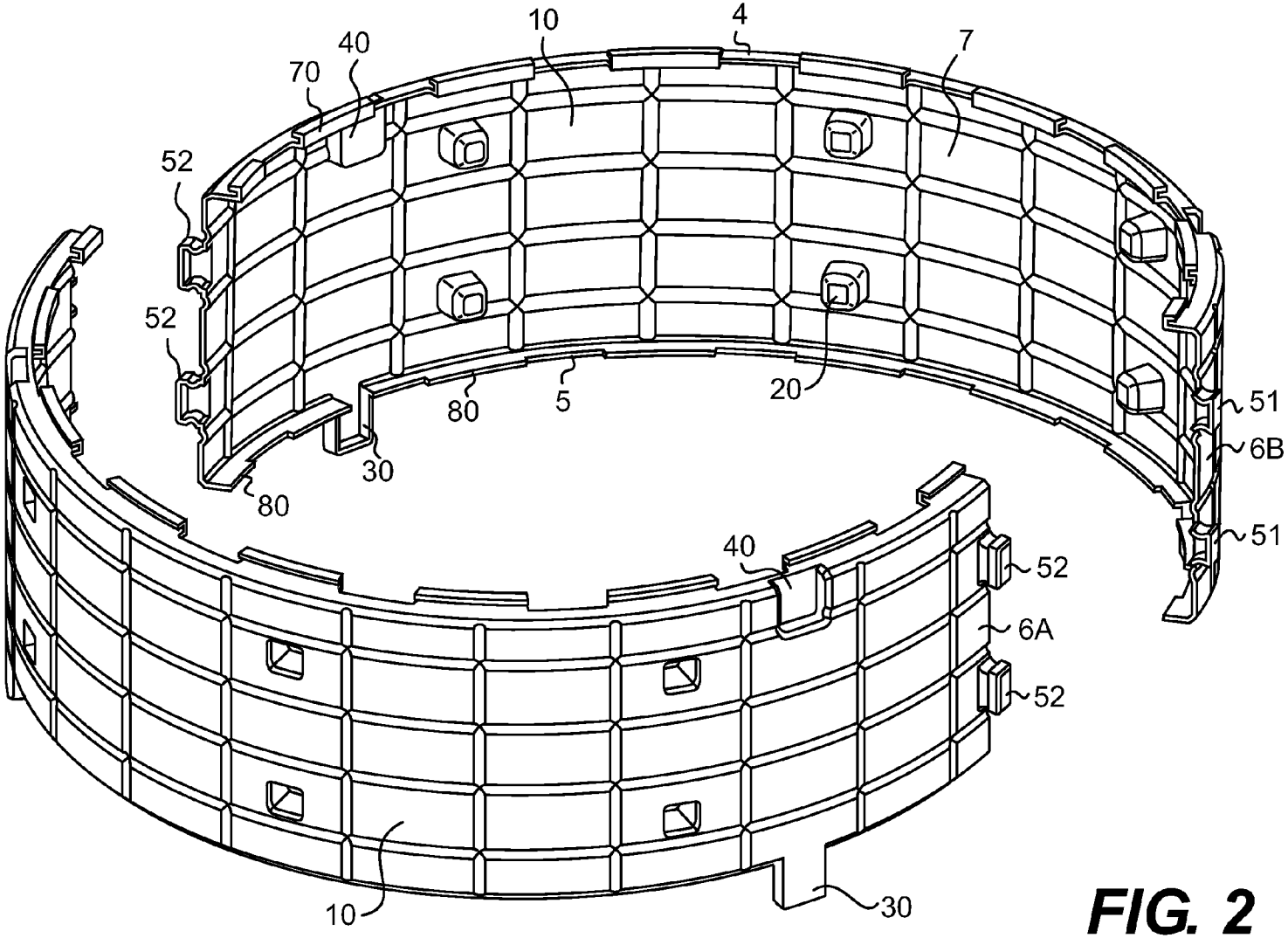
FIG. 2 is a perspective view of the cover shown in FIG. 1 having two cover segments.

FIG. 2 shows a pair of cover segments 10 that when laterally joined cover a circular cylindrical support 1. Each of the segments 10 includes lateral connectors 50, support legs 30, support leg slots 40, a plurality of stand offs 20, groove interconnector 70, and tongue interconnectors 80. When cover segments 10 are connected using the lateral connectors 50, support legs 30, support leg slots 40, groove interconnector 70, and tongue interconnectors 80, a uniform cover 2 is provided that is impermeable to a precipitation and resultant chemical mixture from the application of chemicals (e.g., road salts) added to a roadway.

As shown primarily in FIGS. 1 and 2, a plurality of stand offs or spacers 20 are formed in each cover segment 10. The stand offs are arranged in evenly spaced intervals on the cover segment 10 about 60 degrees apart in one embodiment; however, the arrangement may be adjusted according to the support structure 1 being covered.

The stand offs 20 are formed as a pocket molded inwardly from the outer surface 3 of the cover segment 10 and as a result extend inwardly toward the support structure 1 when the cover segment 10 is installed. As a result of the formation, a stand off pocket 22 is formed. The stand offs 20 function as spacers to keep the cover 2 from being held in full contact with the surface of the support structure 1. Additionally, as shown in FIG. 8, which is a detailed view of the cross sectional view of FIG. 7 taken along line 7-7 of FIG. 4, a gap 21 for tolerance of expansion may be provided between the stand off 20 and the surface of the support structure 1. The gap 21 allows for expansion of the support column 1 material (concrete) due to fluctuations in temperature, for example. Accordingly, the stand offs 20 are not all in contact with the support structure 1, and depending on the expansion state of the support structure 1, a gap 21 may exist between the support structure 1 and several of the stand offs 20.

Each cover segment 10 is provided with a plurality of support legs 30 according to embodiments of the invention, which are formed along the base or bottom portion 5 of the cover segment 10. FIGS. 1 and 2 show support legs 30 extending downwardly from a bottom edge 34 of the segment 10 to make contact with the surface of the ground or other area surrounding the support structure 1. Additionally, support legs 30 provide a point of contact with the area surrounding the support structure 1 that are suitable for supporting the weight of the cover 2. Two support legs 30 per segment 10 are shown in the drawings; however, additional support legs 30 are possible for supporting a segment 10.

FIG. 1 shows the support legs 30 to have a square profile, however the profile of the support legs 30 may alternatively be tapered, pointed or curved at the ground engaging portion. An additional function of the support legs 30 is to raise or elevate the bottom portion 5 of the cover segment 10 so that a clearance 60 is provided between the bottom edge 34 and the area surrounding the base of the support structure 1 to provide for space at the bottom of the segment in which air can flow. At the top portion 4 of the cover, air is also able to flow through channels 8. By permitting air flow underneath the cover 2, between the cover 2 and the support structure 1, and through the top portion 4, accumulation of moisture is prevented. Additionally, the support legs 30 elevate the cover segment 10 to enable a worker to inspect the integrity of the support column 1 by viewing the support structure 1. For example, visual observation is available for the detection of spalling or defects. The clearance 60 created as a result of the support legs 30 further allows a space for a worker to conduct maintenance of the support structure 1. The support legs 30 also provide an area for liquid, such as rain water, to escape.

FIG. 1 shows a first pair of segments 10 on which are stacked a second pair of segments 10 to form a modular cover 2 having a total of four segments 10. Each cover segment 10 is provided with a plurality of support leg slots 40 along a top portion 4 of the cover. The support leg slots 40 are formed into the outer surface 3 of the top portion 4 of each cover segment 10 and are formed into a shape that accepts the corresponding support leg 30 of a vertically adjacent segment 10 when the segments 10 of a second pair are stacked on top of a first pair, as shown in FIG. 1. Upon connection, the outer surface 3 of the support leg 30 of the upper cover segment in FIG. 1 is flush with the outer surface 3 of the cover segment 10 below. It is apparent that the support legs 30 of one cover segment 10 align with the support leg slots 40 of another cover segment in that the support legs 30 and the support leg slots 40 are spaced at the same intervals. The support leg 30 and support leg slot 40 engagement when the cover segments 10 are being stacked in the installation process, assists in the alignment of the cover segments 10.

Figure 7:
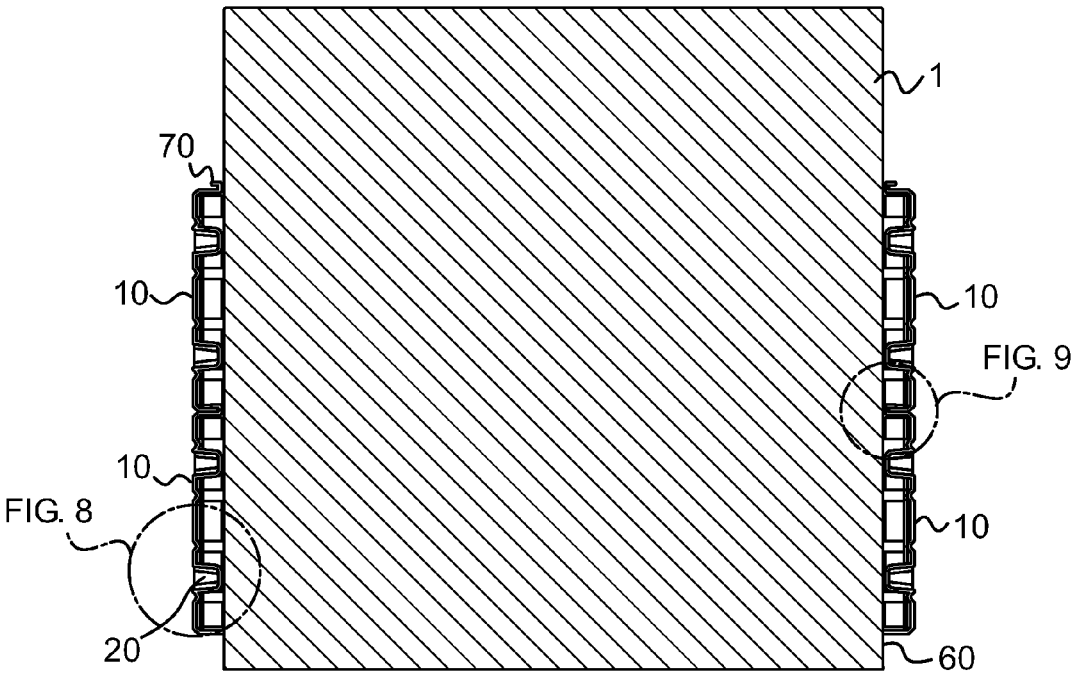
FIG. 7 is a cross section of the cover of the first embodiment along the 7-7 line of FIG. 4.
Figure 8:
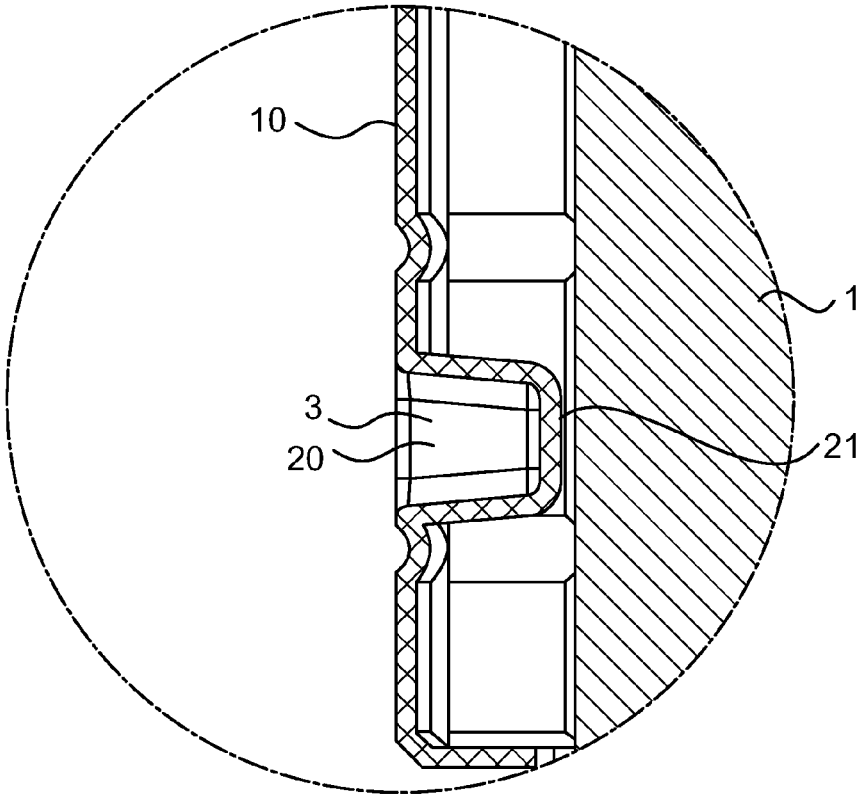
FIG. 8 is a partial sectional view of the cover segments of the first embodiment showing a stand off feature of the cover segments according to an embodiment of the invention.
Figure 9:
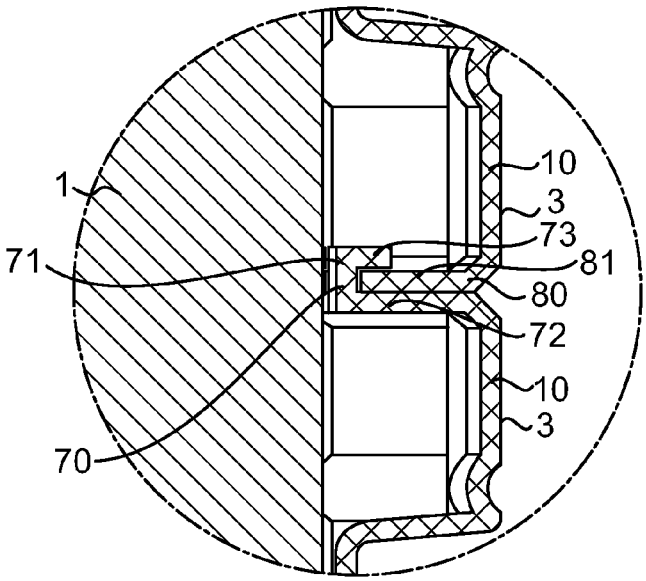
FIG. 9 is a partial sectional view of the cover segments showing a tongue and groove feature for vertically attaching cover segments according to an embodiment of the invention.

FIG. 9 is an enlarged detailed view of the area circled and labeled in FIG. 7. FIG. 7 is a cross sectional view of a cover 2 taken along line 7-7 of FIG. 4. FIG. 9 shows the tongue 80 of an upper stacked segment 10 engaged with the groove 70 of a lower segment 10 of cover segments 10 that are stacked vertically. As shown in FIG. 1, a plurality of groove interconnectors 70 are formed on the top portion 4 of each cover segment 10. The groove interconnectors 70 are arranged at intervals in alignment with the corresponding tongue interconnectors 80, which are formed along the bottom portion 5 of each cover segment 10. Groove interconnectors 70 are formed as J-shaped flanges that provide a groove opening outwardly which accepts the corresponding tongue connectors 80 which are formed along the bottom edge 34 as shown in FIG. 1, for example. This enables the tongue interconnector 80 of an upper vertically adjacent cover segment to engage the groove interconnector 70 of a vertically adjacent and lower cover segment 10 to connect the cover segments 10 together.

FIG. 9 shows a portion of the tongue interconnector 80 that fits into the space provided by the groove interconnector 70 so that the end portion of the tongue interconnector fits up against the back of the groove, abutting upstanding flange portion 71 with an appropriate tolerance for accommodating expansion and contraction due to changes in temperature, for example. In this way, the outer surface 3 of each cover segment 10 is even with each other segment 10 so that the outer surfaces 3 of the segments are flush with each other. The tongue interconnector 80 engages the groove interconnector 70 such that the flat bottom portion 81 of the tongue 80 engages the adjacent flat portion 72 of groove interconnector 70, with appropriate tolerance, to provide a connection between adjacent, vertically stacked cover segments 10. Through the engagement of the groove interconnector 70 and tongue interconnector 80, the stacked cover segments 10 are appropriately aligned so that the so that the outer surfaces 3 of the segments 10 are flush with each other to provide an appearance that the segments 10 form a continuous, essentially uninterrupted outer surface to the eye of the observer.

Each cover segment 10 includes a plurality of lateral connectors 50 formed on the sides 6A, 6B of each cover segment 10. The lateral connectors 50 are arranged to align with corresponding lateral connectors 50 and connect in their respective ways and according to the following descriptions of the embodiments.

Figure 3:
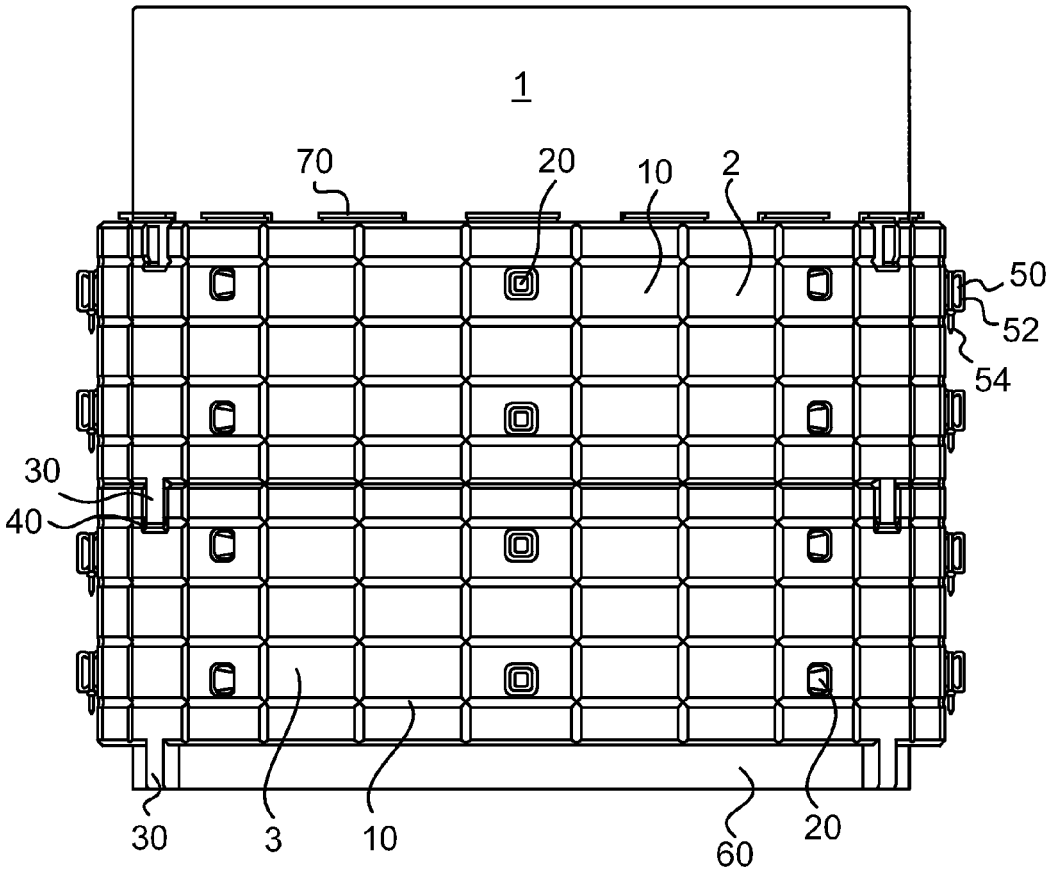
FIG. 3 is a plan view of first and second pairs of cover segments, each segment of one pair joined laterally with the other segment of the pair, and the first and second pairs stacked vertically according to an embodiment of the invention.
Figure 4:
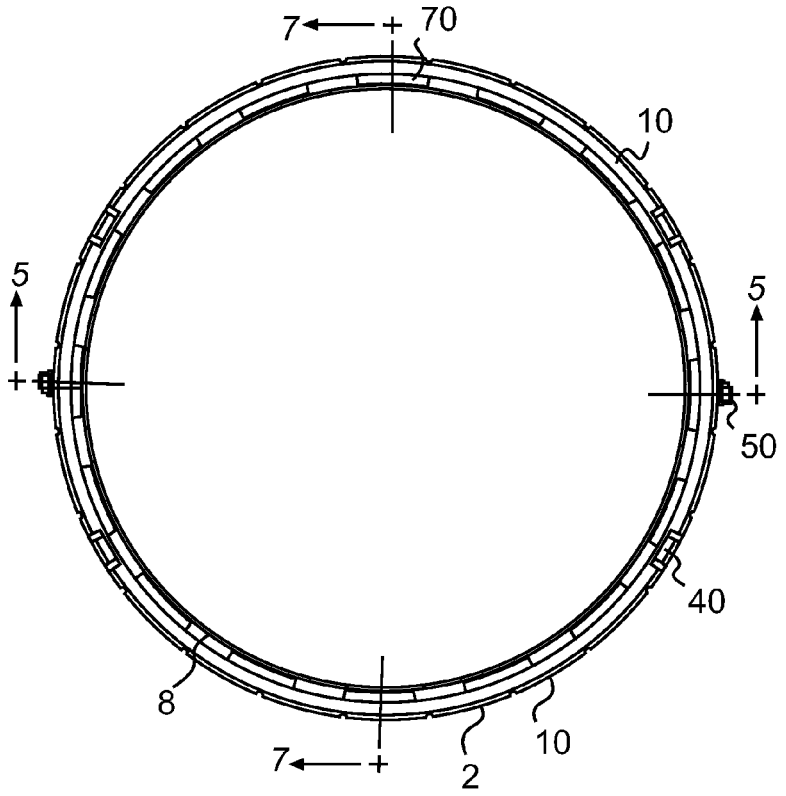
FIG. 4 is a top view of the cover of the present invention.
Figure 5:
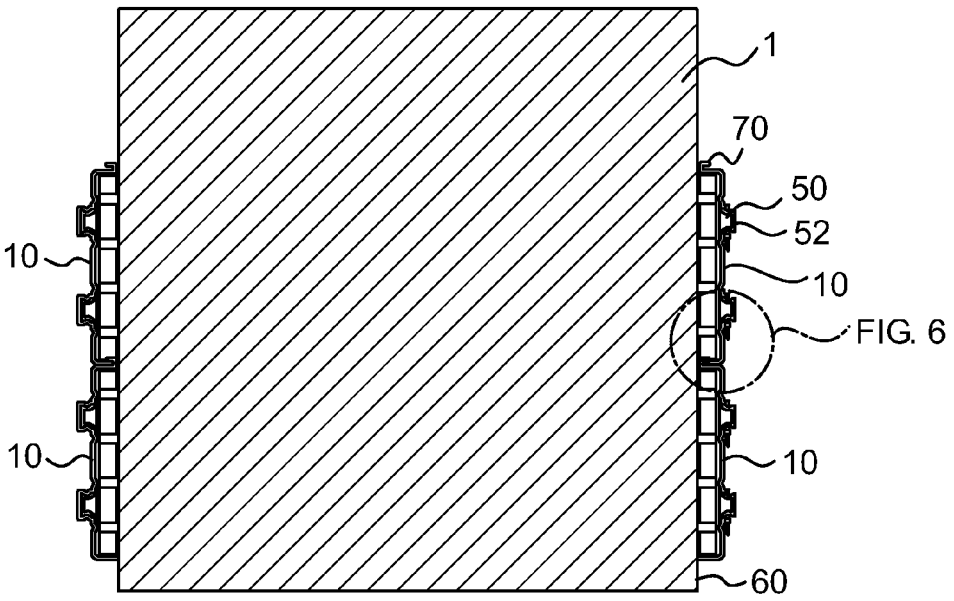
FIG. 5 is a cross section of the cover of the first embodiment taken along line 5-5 of FIG. 4.

FIG. 4 shows a different view of the cover 2 shown in FIG. 3 and FIG. 5 is a cross section of FIG. 4 across the 5-5 line. The cover segment 10 of the first embodiment includes a plurality of connector tabs 51 and a plurality of tab receivers 52, constituting lateral connectors 50, formed into the cover segment 10. The connector tabs 51 are formed on one side (6B in FIG. 2) of a cover segment 10 and tab receivers 52 are formed on the opposite side (6A in FIG. 2) of a cover segment 10. FIG. 2 shows two cover segments 10, which are not connected; while FIG. 1 shows the cover segments 10 connected to form a cover 2 of the present invention. Sliding the connector tabs 51 on one cover segment 10 into the tab receivers 52 of another cover segment 10 makes a lateral connection. As shown in FIG. 2, the tab receivers 52 of side 6A of the cover segment 10 are configured to receive the connector tabs 51 of side 6B of another cover segment 10.

Upon connection, as shown in FIG. 1, the faces of the edges of each side 6A, 6B contact and abut each other to form a seam in the cover 2. However, the integrity of the cover 2 is not diminished as a result of the seam.

Figure 6:
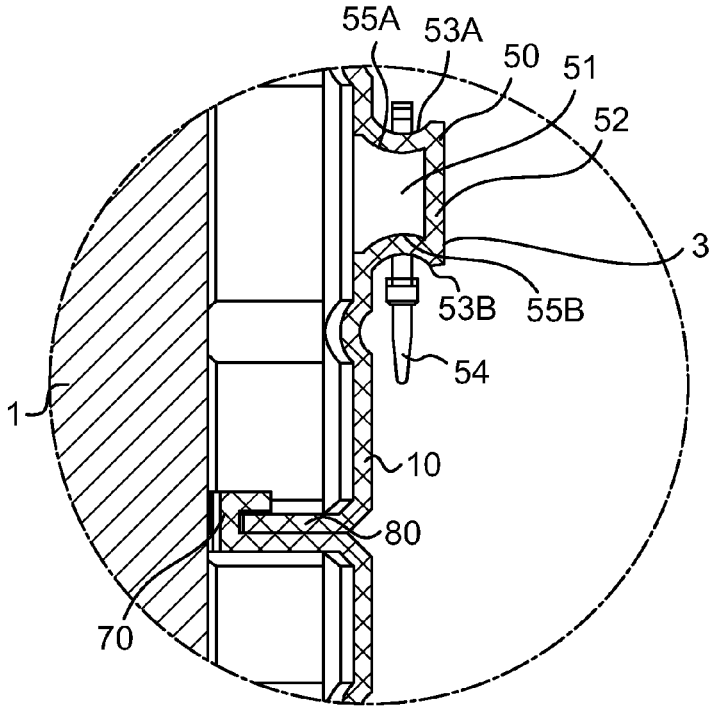
FIG. 6 is an enlarged partial sectional view of a connecting area of the cover segments of the first embodiment.

As shown in FIG. 6, when the connector tab 51 and tab receiver 52 are connected only the tab receiver 52 is visible on the outside. The connector tab 51 and tab receiver 52 are formed to extend outward from the outer surface 3 of the cover segment 10.

The shape of the connector tab 51 is structured to correspond with the shape of the tab receiver 52 so that the connector tab 51 fits in the tab receiver 52. In particular, the top concave portion 53A of the tab receiver 52 is shaped to correspond to the top concave portion 55A of the connector tab 51. Additionally, the bottom concave portion 53B of the tab receiver 52 is shaped to correspond to the bottom concave portion 55B of the connector tab 51. As a result of this configuration, the connector tab 51 fits firmly inside the tab receiver 52. The lateral connectors 50 of each embodiment provide for appropriate tolerance for accommodating expansion and contraction due to changes in temperature, for example.

Figure 10:
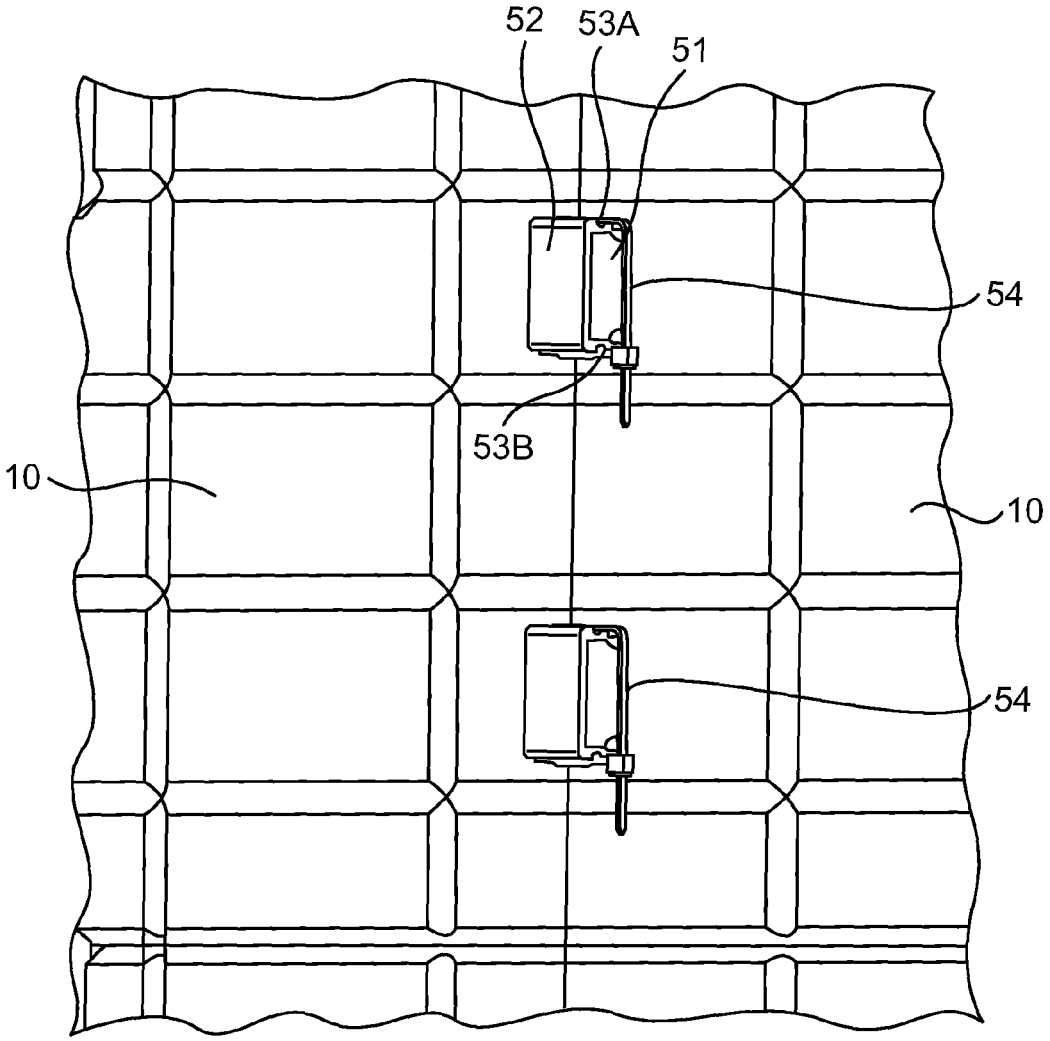
FIG. 10 is a partial plan view of the cover segments of the first embodiment showing cable ties for horizontally or laterally connecting cover segments.

FIG. 10 shows a flexible fastener 54, which is preferably a zip-type tie. Upon connection of the cover segments 10 according to the first embodiment, the fastener 54 is placed around the tab receiver 52 and fastened to maintain the connection of the tab receiver 52 and connector tab 51. The top surface of the top concave portion 53A and bottom surface of bottom concave portion 53B of the tab receiver 52 guide the fastener 54 and provides for a notch-type area for the fastener 54 to be placed.

Figure 13:
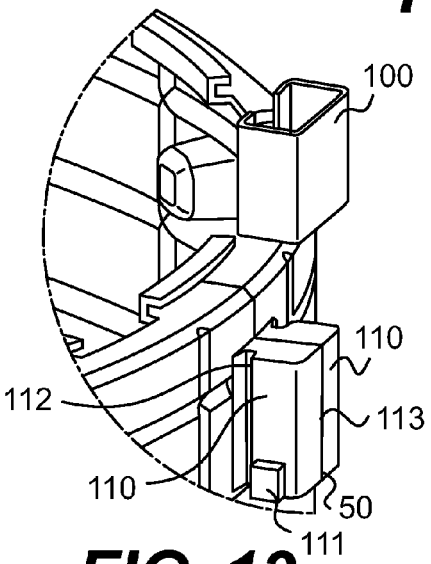
FIG. 13 is a partial perspective view of the cover segments to be joined laterally according a second embodiment of the present invention which uses a sleeve connection feature for horizontally connecting cover segments.
Figure 14A:
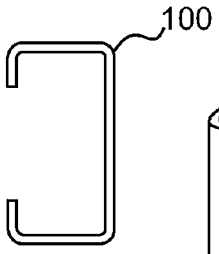
FIG. 14A is a top view of the sleeve of the second embodiment.
Figure 14B:
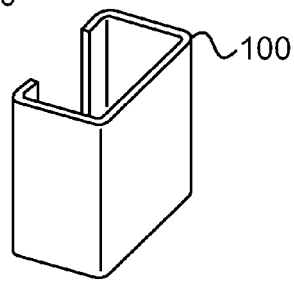
FIG. 14B is a partial perspective view of the sleeve of the second embodiment.
Figure 15:
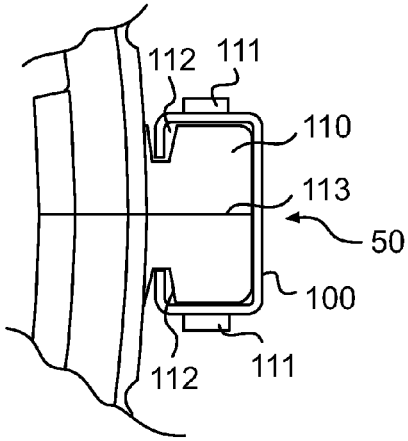
FIG. 15 is a top view of cover segments of the second embodiment showing two cover segments connected using the sleeve connection feature for horizontally connecting cover segments.

The cover segment 10 of the second embodiment of the present invention includes lateral connectors 50 of another configuration. FIGS. 13 and 15 show connector blocks 110, which are fastened using a sleeve 100. A plurality of connector blocks 110 are provided on the sides 6A, 6B of each cover segment 10. The connector blocks 110 are preferably formed in a block or cube type shape and extend outward from the outer surface 3 of the cover segment 10. As shown in FIGS. 13 and 15, a stop block 111 is provided on each connector block 110 to engage the sleeve 100. A C-shaped sleeve 100 is shown in FIGS. 14A and 14B which has 4 faces and is shaped to slide down the connector blocks 110 to maintain the connection of the cover segments 10. Sleeve notches 112 are formed to accept the open face of the sleeve 100.

The open ended face of the sleeve 100 faces the cover and slides down through sleeve notches 112 formed into each connector block 110. The sleeve notches 112 accept the opposing open ends of the sleeve 100 and allow the sleeve 100 to slide down and engage stop blocks 11. The faces of the connector blocks 110 contact and abut each other when the sleeve 100 is in place, as shown in FIG. 15.

Figure 16:
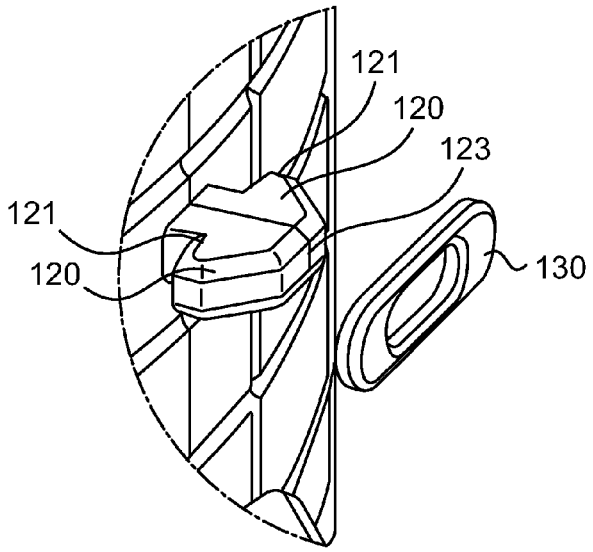
FIG. 16 is a partial perspective view of cover segments according to a third embodiment of the present invention in which a band connection horizontally connects the cover segments.
Figure 18:
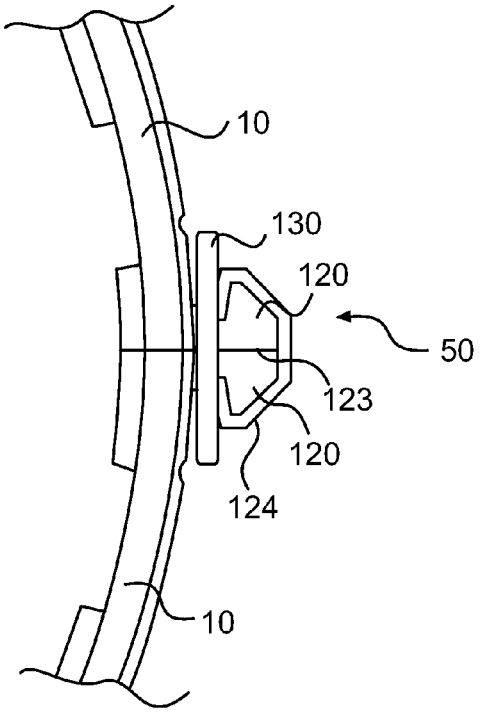
FIG. 18 is a partial top view of the cover segments of the third embodiment showing two cover segments connected using the rubber tie connection feature for horizontally connecting cover segments.
Figure 17:
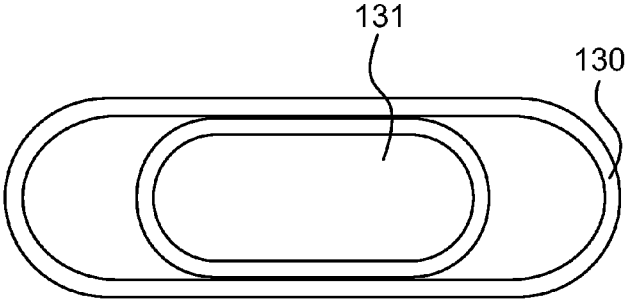
FIG. 17 is a top view that shows the band connector for the cover segments of the third embodiment.

Third embodiment includes yet another form of lateral connectors 50 of the present invention. Each cover segment 10 has a plurality of flange portions 120 for joining cover segments 10 in the lateral direction. As shown in FIGS. 16 and 18, the flange portions 120 extend outward from the outer surface 3 of cover segment 10 and are provided on the sides 6A, 6B of each cover segment 10. Upon connection of the cover segments 10 in the lateral direction to form a cover 2, the flange portions 120 of respective cover segments 10 become aligned and abut each other so that the respective faces of the flange portions 120 contact each other. The faces of the flange part 123 are substantially flat and are formed substantially perpendicular to the outer surface 3 of the cover 10. Further, upon abutment the faces of the flange part 123 appear even and flush to an observer.

As shown in FIG. 18, a shoulder portion 121 and a tie notch are formed into each flange portion 120. Flange portions 120 are provided with a tapered outer portion 124 that is useful for accepting a band 130 which can be fit around the outer most end of the tapered portions 124, expand over the shoulder portions 121 and become seated to encircle the flange portions 120 for retaining the flange portions 120 in abutment with one another.

The band 130 functions to keep the face of the flange parts 123 in contact. In other words, the band 130 maintains the lateral connection between the substantially flat face of the flange part 123 and as a result, maintains the connection of the cover segments 10 to form a cover 2. The band 130 is preferably a stretch band, which allows for relative expansion due to changes in temperature caused by weather changes, for example. The band 130 includes an opening 131 to fit around the flange portions 120 and may be made of a flexible material, such as rubber.

Figure 19:
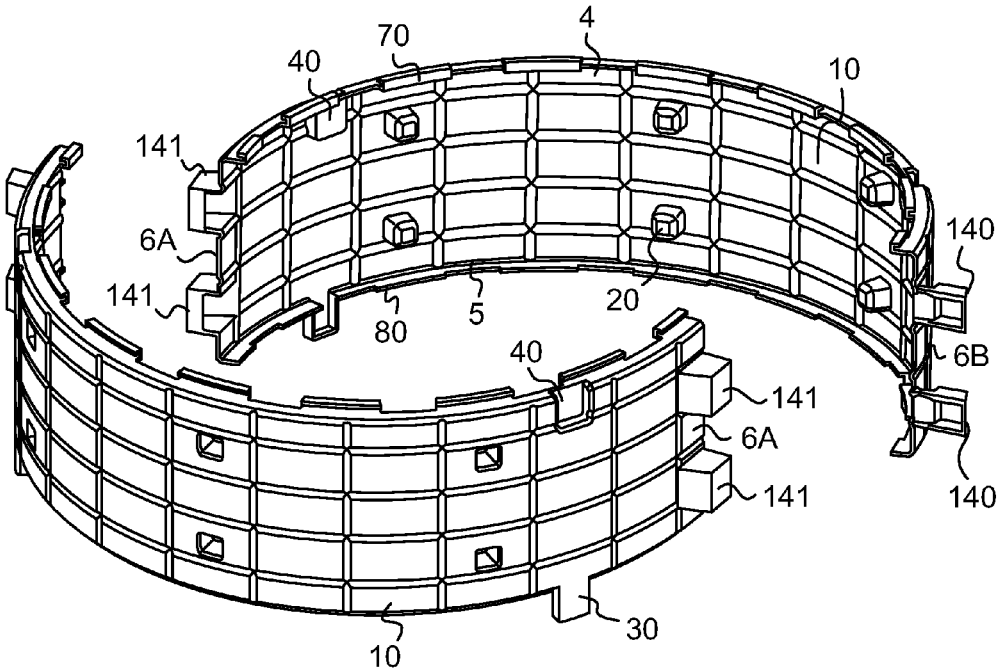
FIG. 19 is a perspective view showing two segments of a cover of a fourth embodiment.

FIG. 19 shows the lateral connectors 50 of the fourth embodiment of the present invention. On each side 6A, 6B of the cover segment 10 are disposed a plurality of overlying parts for securing the cover segments 10 to an adjacent cover segment 10 in the lateral direction (or for securing opposite sides 6A, 6B of the cover segment so they connect).

Figure 20:
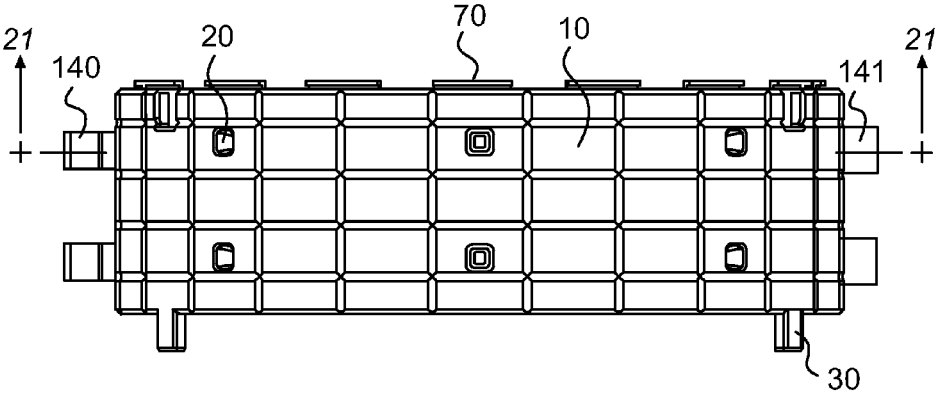
FIG. 20 is a plan view showing a segment of the cover of the fourth embodiment.
Figure 21:
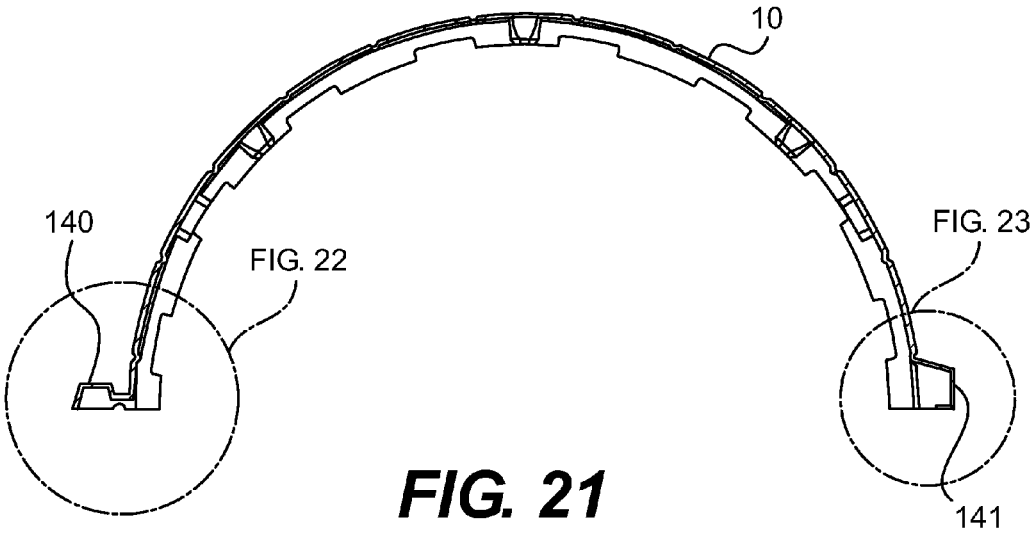
FIG. 21 is a cross sectional view of the cover of the fourth embodiment taken along line 21-21 line of FIG. 20.
Figure 22:
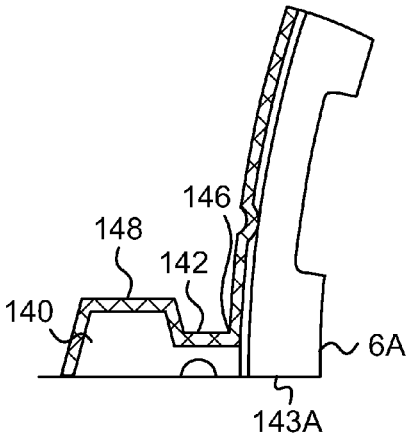
FIG. 22 is a partial sectional view taken from FIG. 21 of the cover of the fourth embodiment showing one end of a connector for horizontally connecting cover segments.
Figure 23:
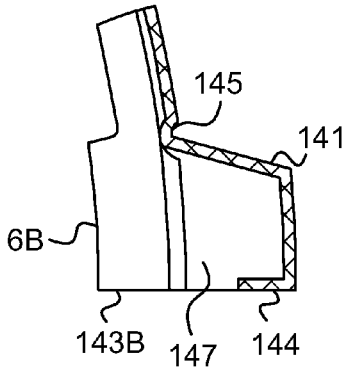
FIG. 23 is a partial sectional view taken from FIG. 21 of the cover of the fourth embodiment showing one end of a connector for horizontally connecting cover segments.

FIG. 21 shows a cross section taken along 21-21 of FIG. 20 of the cover segment 10 of the fourth embodiment showing cap part 141 and concave shaped structure 140. At one end, a concave shaped structure 140 has a shell 148 with a shoulder step flange 142 that fits within a cap part 141, through the open cavity of cap part 141. The concave shaped structure 140 has a living hinge (not shown) that provides rotation of the shell 148 about hinge line 146. When the shell 148 swings down 90° from the position shown in FIG. 22 to be in line with the cover segment 10, the cap 141 fits over the shell 148 to securely fasten the concave shaped structure 140 and cap part 141 together. As shown in FIG. 23, the cap 141 has a terminal flange 144 that engages the step flange 142 and is kept in the position by a bias force applying area 145 that is preferably molded into the cap part 141. Upon connection of the concave shaped structure 140 and the cap part 141, the edges 143A and 143B of the cover segment abut each other evenly and are flush to an observer.

Each of the cover segments 10 of the embodiments of the present invention may be shaped to correspond to the shape of the support structure. FIG. 2. shows two cover segments 10 that are each shaped in 180° semi circles to form a cover, when connected, around a support column 1 that has a circular cross section. However, the cover segments 10 may be shaped to form around a column or post with n (n is an integer) number of flat or curved faces. As an example, the cover segments may be shaped to form a cover around a support structure which has a cube, box, or square type structure that has 4 flat faces.

Another example of the shape of a support structure that the cover segments of the present invention may be shaped to cover is one that has two flat opposing sides and two curved opposing sides. In this example, a combination of linearly shaped cover segments and curve shaped cover segments are connected to form a cover according to the techniques herein described.

Figure 11A:
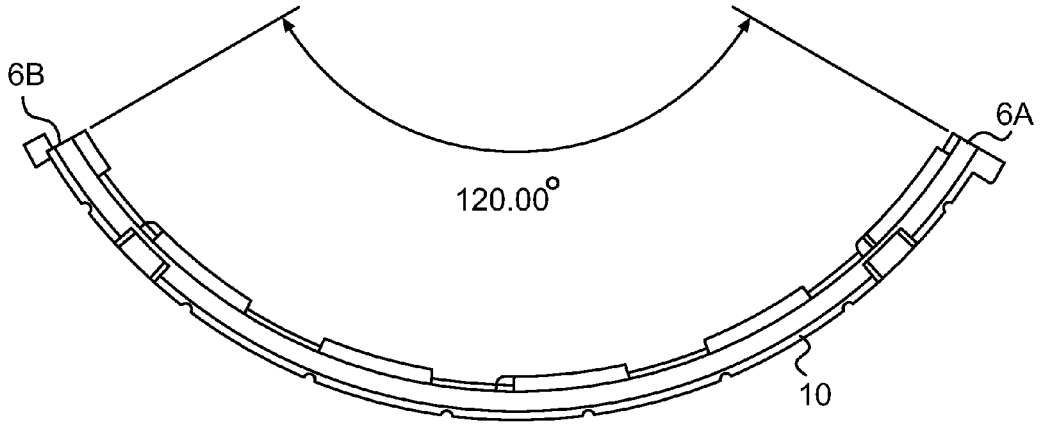
FIG. 11A is a top view of a segment of the cover.
Figure 11B:
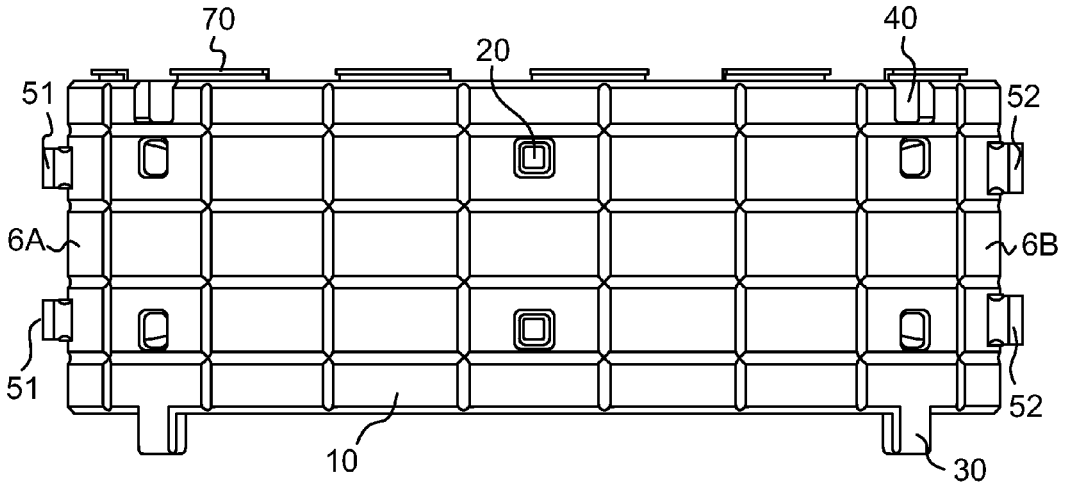
FIG. 11B is a plan view of a cover segment of FIG. 11A.
Figure 12A:
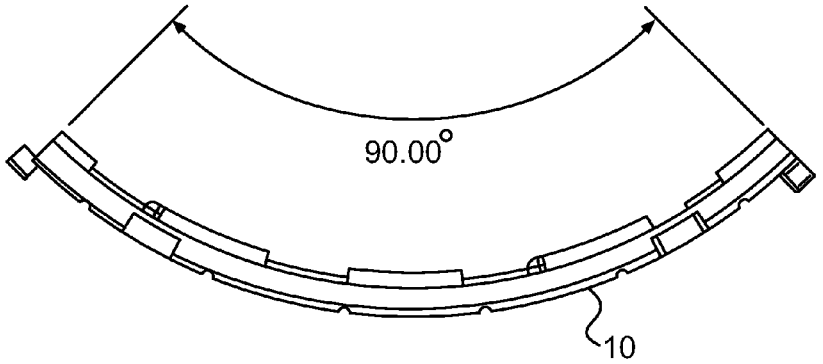
FIG. 12A is a top view of a cover segment of the cover according to another embodiment.
Figure 12B:
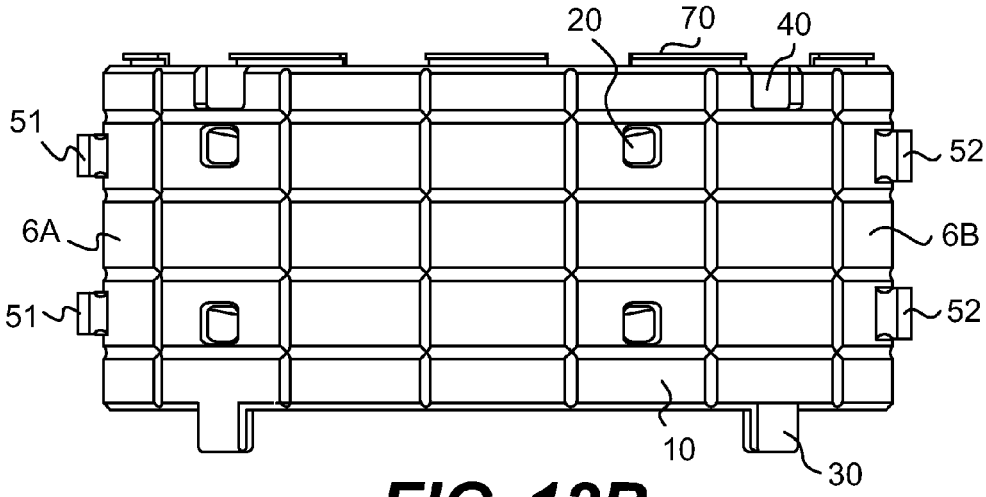
FIG. 12B is a plan view of the cover segment of FIG. 12A.

Additionally, the present invention allows for the module connection of cover segments of varying lengths (as measured form one side 6A to the other 6B). For example, FIGS. 11A and 11B show a cover segment 10 may be formed in a 120° segment (which has a length shorter than a 180° cover segment) and FIGS. 12A and 12B show a cover segment 10 may be formed in a 90° segment (which has a length shorter than a 120° segment).

The outer surface 3 of each cover segment 10 may also be customized with a variety of profiles and textures for aesthetic appeal. For example, the outer surface may resemble brick, stone, or concrete. The outer surface 3 may be any color and preferably a color that suits its environment.

The cover segments 10 and components (except for sleeve 100 and band 130) discussed above are also preferably molded using a single mold so that the cover segment is formed to be one piece that includes the lateral connectors 50 and vertical connecting techniques. The components may also be separately manufactured and added to a cover segment.

Described next are embodiments of devices and processes for installing the cover 2 of the present invention. Cover segments 10 are first connected laterally using any of the lateral connection techniques described in the embodiments of the present invention. For reference, the connection of cover segments 10 in the lateral direction around a support column 1 will be referred to herein as an assembly of cover segments 10. In order to cover the vertical span of a support column 1, multiple assemblies are stacked vertically (in layers) to a desired height.

Figure 24:
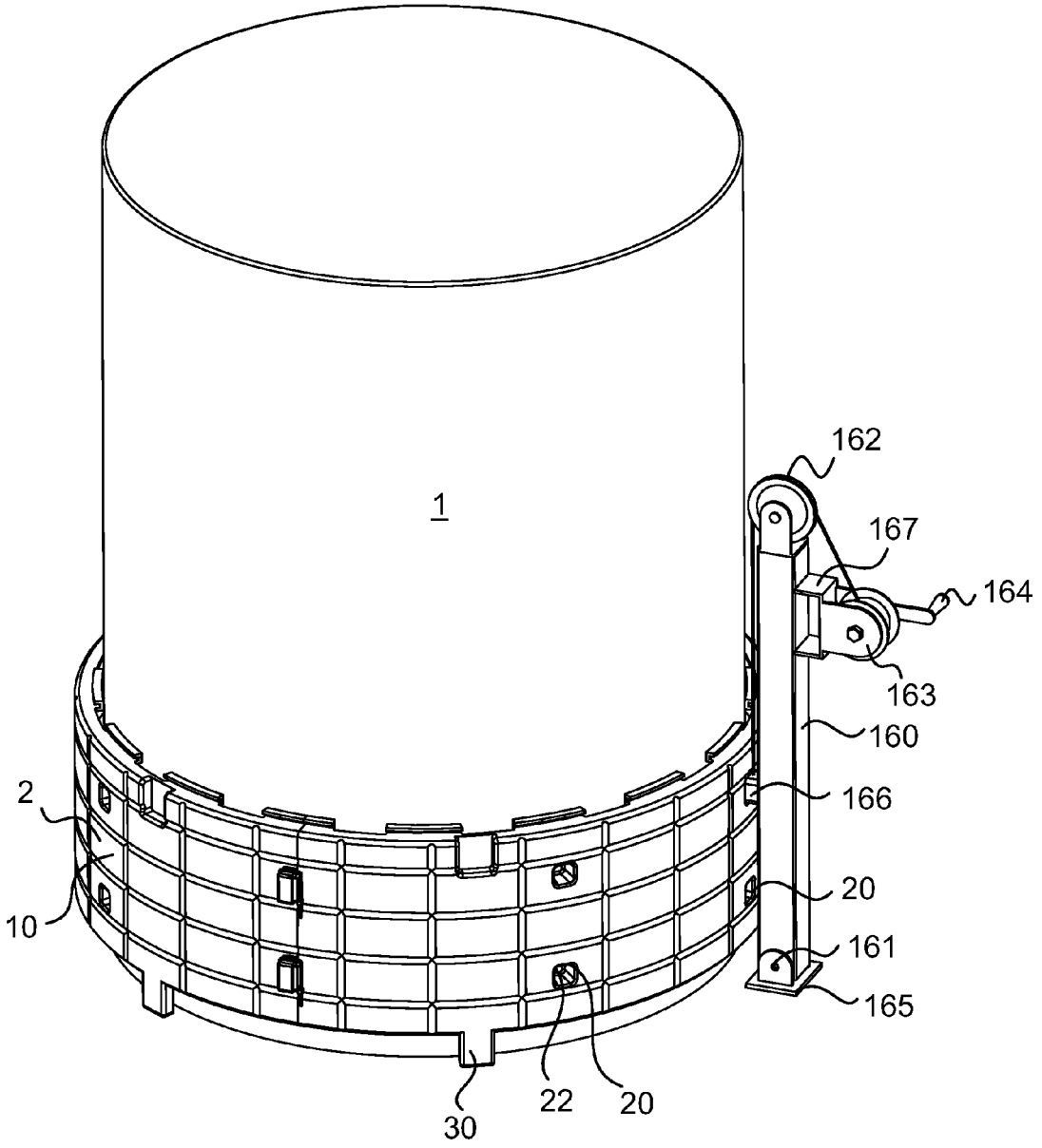
FIG. 24 is a perspective view of the cover and vertical jack according to an embodiment of the invention.

FIG. 24 shows cover segments 10 connected to form an assembly (laterally connected cover segments 10) in a first position. One or more vertical jacks 160 are provided to lift an assembly to a second position shown in FIG. 26. The vertical jacks 160 may be used to lift or lower any of the combination of the cover segments 10 described above. Additionally, the vertical jacks 160 are portable and capable of raising and lowering multiple assemblies that have been vertically staked on top of one another.

Figure 25:
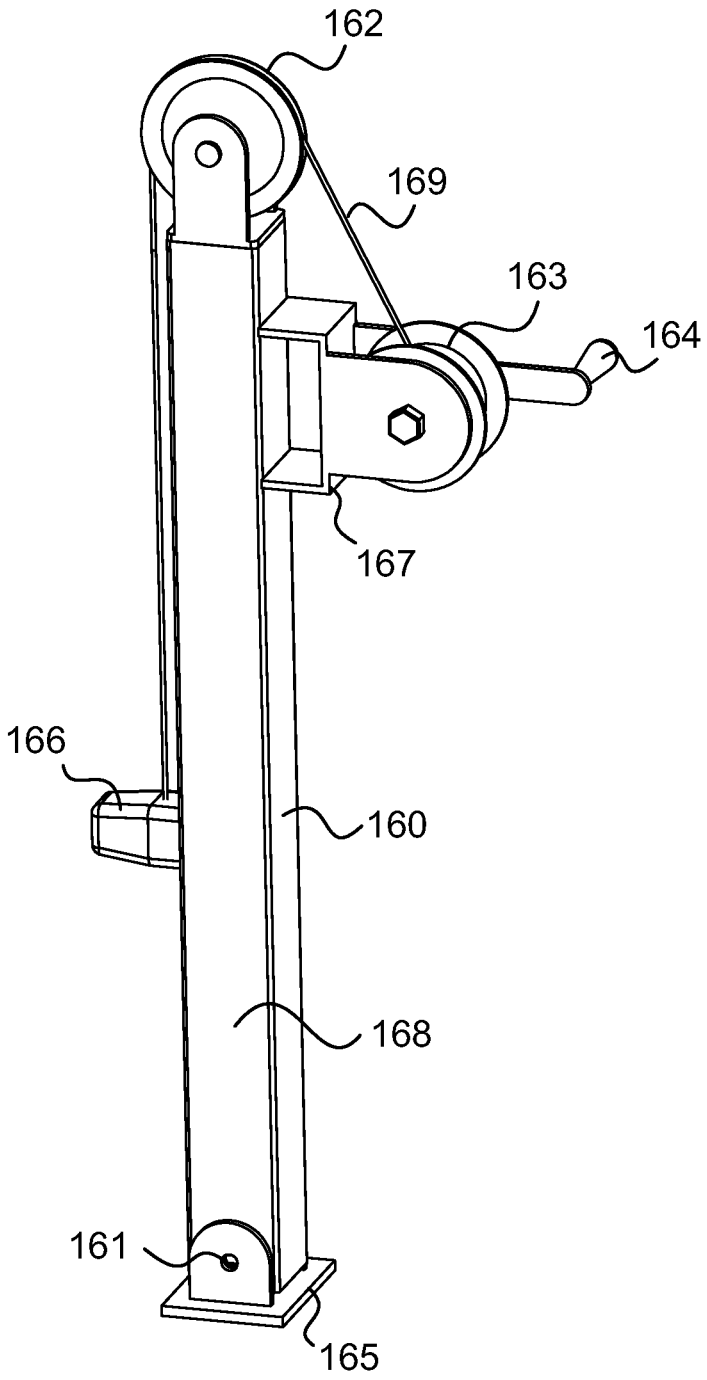
FIG. 25 is a plan view of a vertical jack of according to an embodiment of the invention.

One embodiment of a vertical jack 160 is shown in FIG. 25 and is provided with a base 165 that supports a jack shaft structure 168. The jack shaft 168 is connected to a base 165 by a base bracket 161. The support jack 160 is also provided with a crank mechanism 163, which is connected to the jack shaft 168 by a crank mechanism bracket 167. The crank mechanism 163 may include a winch mechanism provided to crank a cable 169 which is attached at one end to a jack stand off insert 166. The other end of the cable 169 is attached to a spool of the crank mechanism 163 as it goes through a pulley 162, which is provided on top of the vertical jack shaft 168. As shown in FIG. 24, one end of the jack stand off insert 166 is inserted into a stand off pocket 22 of a cover segment 10. The opposite end of the jack stand off insert 166 fits into and is guided by a track inside of the jack shaft 168. The track spans vertically along the jack shaft 168 and allows the jack stand off insert 166 to move in the vertical direction.

Figure 26:
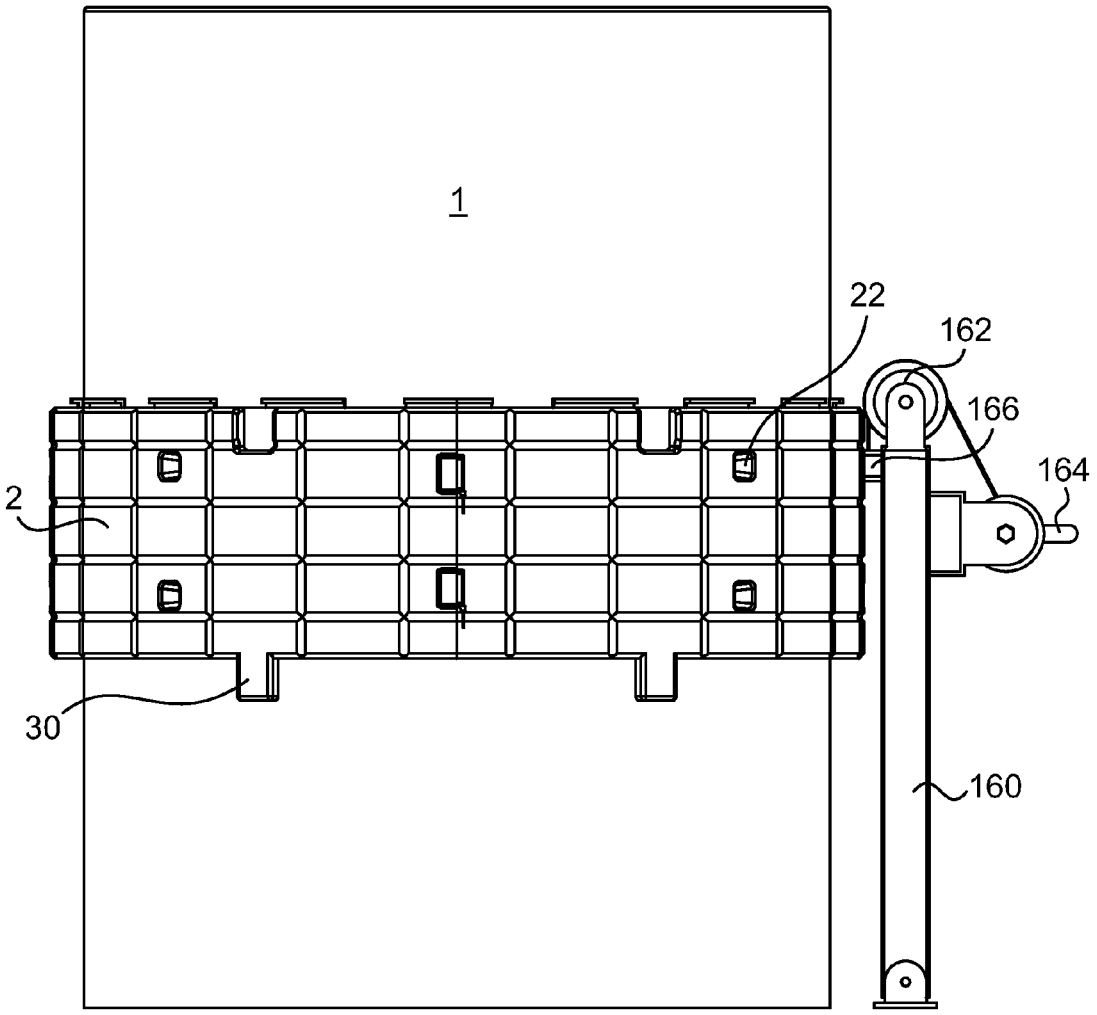
FIG. 26 is a perspective view showing a cover assembly raised by a vertical jack according to an embodiment of the invention.
Figure 27:
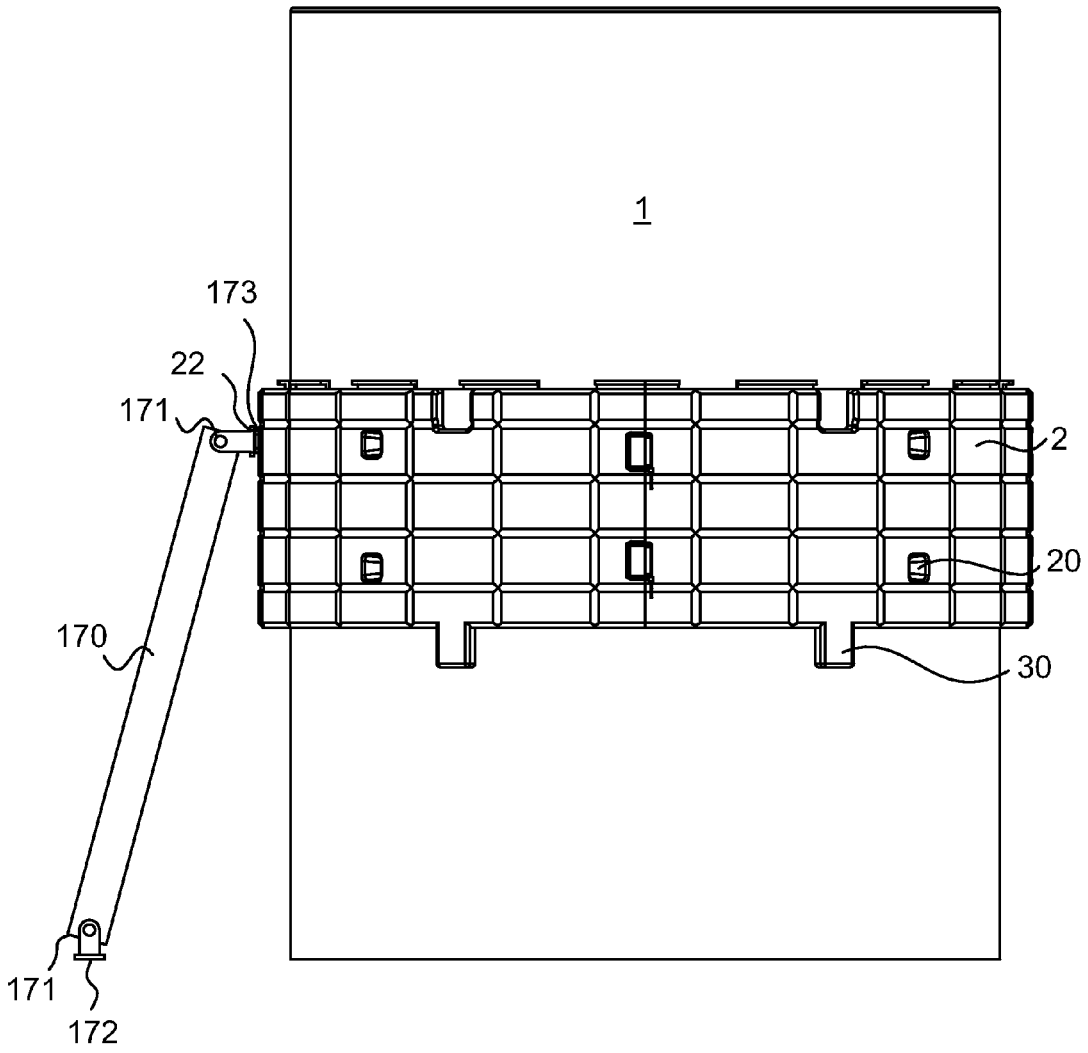
FIG. 27 is a perspective view showing a cover assembly supported by a pole support according to an embodiment of the invention.

The jack stand off insert 166 is shaped to fit into the stand off pocket 22, which is molded inwardly from the outer surface 3 of the cover segment 10 to form a stand off 20. Accordingly, the jack stand off insert 166 is of a shape and structure corresponding to the stand off pocket 22. Upon inserting the jack stand off insert 166 into the stand off pocket 22 of the cover, the assembly is ready to be raised by a worker by using the crank mechanism 163 to install another vertical layer of cover segments below the initial cover assembly, which is in the second position as shown in FIG. 26. Upon lifting the initial assembly to a desired position, one or more a pole supports 170 are inserted into an available stand off pocket 22 (i.e., not used by a vertical jack). A pole support 170 is inserted by a worker and maintains the raised position of the initial assembly in a reliable manner, for safety, for example. Additionally, the pole supports 170 are capable of supporting more than one layer of vertically stacked assemblies.

Figure 28:
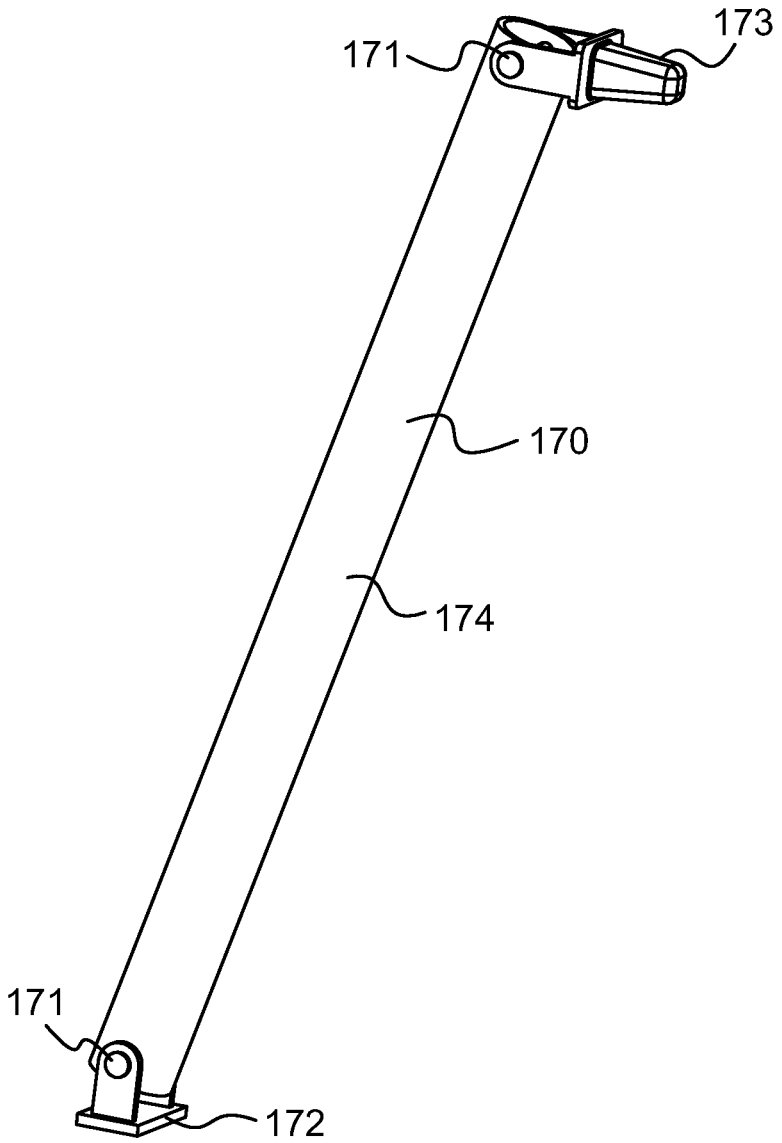
FIG. 28 is a plan view of a pole support according to an embodiment of the invention.

As shown in FIG. 28, a base 172 and pole stand off insert 173 are connected to the pole support shaft 174 using a suitable fixed, pivoted or fixable hinged connection, such as by welding or using a threaded fastener. While the pole support shaft 174 is shown to be used at an angled position with respect to the vertical direction, the pole may be set in a substantially vertical position. In order to secure the pole stand off insert 173 firmly fitted into a stand off pocket 22, a fastening member may be attached therebetween or a cable secured around the periphery of the cover assembly linking several poles together.

Figure 29:
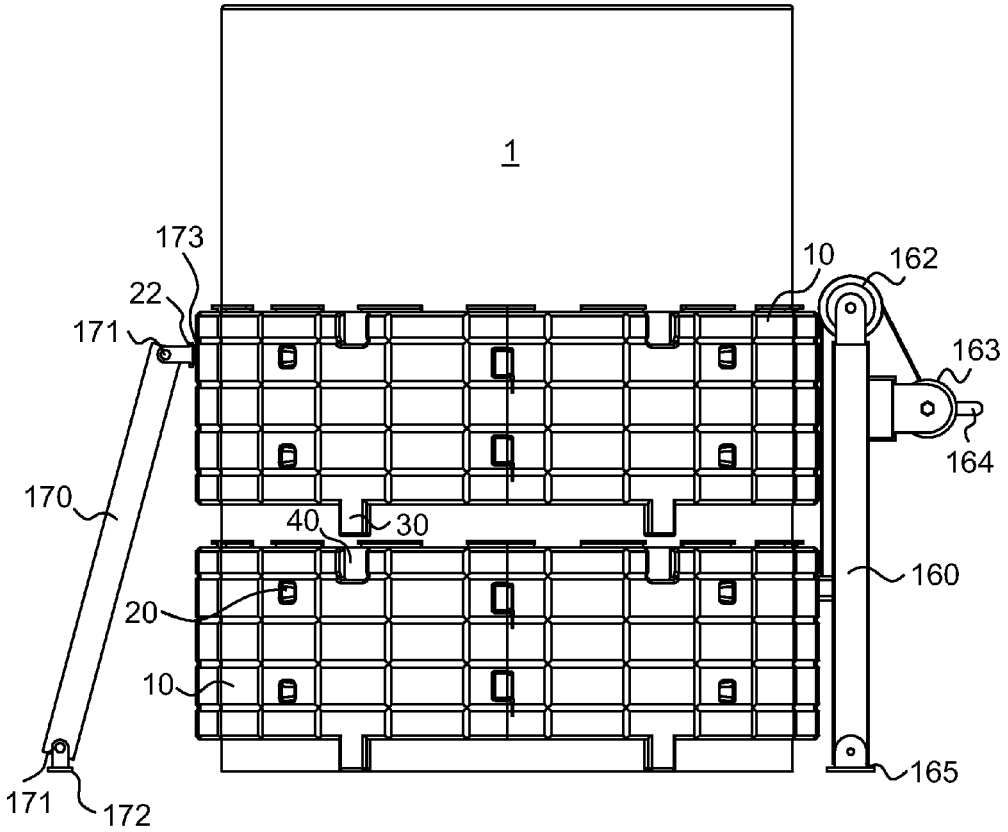
FIG. 29 is a perspective view showing an assembly installed under a raised assembly according to an embodiment of the invention.

FIG. 29 shows another assembly of cover segments 10 installed under the initial assembly which is raised in the second position. The jack stand off insert 166 of the vertical jack 160 is inserted into a stand off pocket 22 of the lower assembly as the pole support 170 supports the above layer. The lower assembly is then raised with the vertical jack 160 to engage the above assembly in the manner described above. In the alternative, the jack stand off insert 166 of the vertical jack 160 may be inserted into the stand off pocket 22 of the above assembly and then lowered to engage the assembly inserted below after the pole support 170 has been removed.

Figure 30:
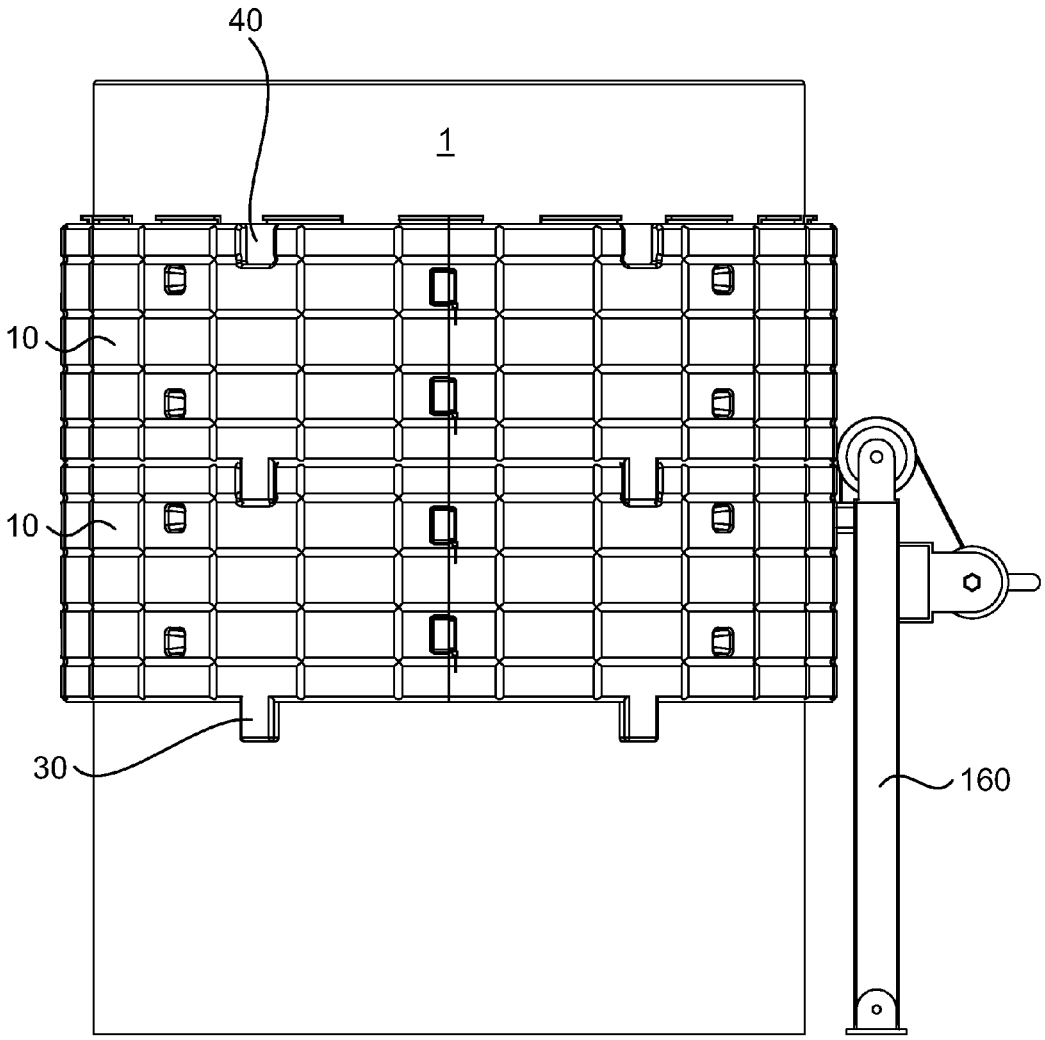
FIG. 30 is a perspective view showing the support jack supporting multiple stacked assemblies according to an embodiment of the invention.

FIG. 30 shows the above and below cover assemblies raised using vertical jack 160 (only one of which is shown for clarity). As shown, the jack stand off insert 166 is inserted into a stand off pocket 22 of the lower assembly. A worker then cranks the crank mechanism to raise the lower assembly, and thereby all assemblies stacked on top, to a desired height to add an additional assembly below, if necessary.

The vertical jack and the pole supports are also useful for disassembly of the modular cover of the embodiments of the present invention.

Figure 31:
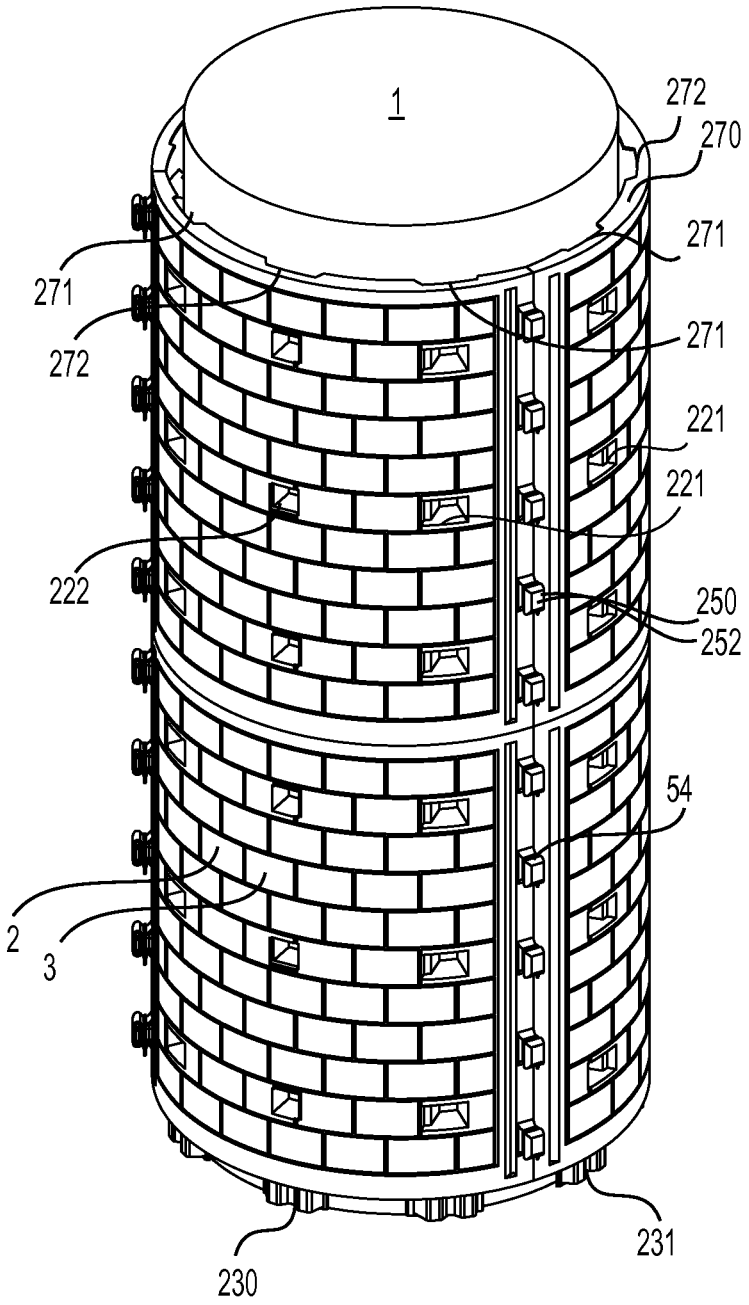
FIG. 31 is a perspective view of a cover according to an embodiment of the invention surrounding a support column

FIG. 31 shows a modular cover or cover apparatus 2 according to yet another embodiment of the present invention. The cover 2 is comprised of a plurality of cover segments 10 that are connected to each other to cover a support structure 1. The support structure 1 as referred to herein is a bridge support column, pier, pillar, pole, abutment or any other component used to support an overpass or a bridge, for example. The figures show a cover 2 in a circular form configured to cover a concrete support structure 1 that has a cylindrical shape. Although the figures show the cover in a circular form to cover a structure that has a cylindrical shape, the cover segments may be manufactured to cover support structures of any shape, such as rectangular, and the shape of the cover is not limited to that shown in the figures.

The cover is modular in that segments 10 are connected laterally (horizontally) together, and also vertically together (stacked on one another) to cover a support structure in situ. Preferably, the cover segments 10 are joined laterally in one vertical layer. The vertical layer is lifted so that another vertical layer of segments 10, which have been joined laterally around the support 1, can be connected underneath the lifted vertical layer. The lifted vertical layer is then lowered onto the lower vertical layer to connect in the vertical direction. The vertical layers of the stacked modular cover 1 are able to be continued to achieve a vertical stack of a desired overall height.

When cover segments 10 are connected using the below described connections, a uniform cover 2 is provided that is impermeable to a precipitation and resultant chemical mixture from the application of chemicals (e.g., road salts) added to a roadway.

Each of the cover segments 10 of the embodiments of the present invention may be shaped to correspond to the shape of the support structure. FIG. 31. shows three cover segments 10 that are each shaped in 120° segments to form a cover, when connected, around a support column 1 that has a circular cross section. However, the cover segments 10 may be shaped to form around a column or post with n (n is an integer) number of flat or curved faces. As an example, the cover segments may be shaped to form a cover around a support structure which has a cube, box, or square type structure that has 4 flat faces.

Another example of the shape of a support structure that the cover segments of the present invention may be shaped to cover is one that has two flat opposing sides and two curved opposing sides. In this example, a combination of linearly shaped cover segments and curve shaped cover segments are connected to form a cover according to the techniques herein described. Additionally, the present invention allows for the module connection of cover segments of varying lengths. For example, a cover segment 10 may be formed in a 180° segment or formed in a 90° segment (which has a length shorter than a 120° segment).

The outer surface 3 of each cover segment 10 may also be customized with a variety of profiles and textures for aesthetic appeal. For example, the outer surface may resemble brick, stone, or concrete. The outer surface 3 may be any color and preferably a color that suits its environment. FIGS. 31 and 32B show an example of a brick pattern on the outer surface 3 of each cover segment 10. While explaining the following embodiment of the cover segment 10, there are similarities to the above described embodiments, which are apparent, and therefore those descriptions are not repeated.

The cover segments 10 and components discussed above are also preferably molded using a single mold so that the cover segment is formed to be one piece that includes the lateral connectors 250 and vertical connecting techniques. Those having ordinary skill in the art also understand that the vertical and horizontal connecting components may be separately manufactured and added to a cover segment instead of using a single mold. Further, the cover segments of the below described embodiment (FIGS. 24-30) use the jack assembly described above in the same manner to install the cover around the support column.

In FIG. 31, a total of six cover segments 10 are connected to form a cover 2. Each cover segment has support legs 230, 231. When a cover is constructed of a multiple cover segments 10 stacked on top of each other in the vertical direction the support legs 230, 231 of the lower cover segments support the cover segment 10 of the cover segments 10 above it. The support legs 230, 231 of the lowest cover segment contact the ground surface. As shown in the illustration of the front and back side of a 120° section cover segment 10, the cover segment has three support legs including a middle support leg 230 and side support legs 231. As shown in FIG. 32A, each support leg 230, 231 is made of a double ribbed 233 design for strengthening characterizes, although other designs may be implemented to further improve the strength of the support legs 230, 231. The support legs 230, 231 will be discussed in more detail below.

Each cover segment 10 has a top interconnector member 270 formed into and along the top edge of the cover segment. The top interconnector 270 extends inward and toward the support structure 1 to be covered at essentially a 90° angle with respect to the surface of the cover segment 10. As shown in FIGS. 32A and 32B, the top interconnector 270 has middle and side grooves 272, 271, respectively, for engaging with and fitting into an indentation in each support foot 234, which is explained in more detail below. Upon vertically connecting cover segments 10, shown in FIG. 31, the top surface of the top interconnector 270 abuts with the lower surface of the bottom extension 280 member.

The bottom extension 280 is formed along and into the bottom edge of the cover segment 10. The bottom extension extends inward and towards the support structure 1 to be covered at essentially a 90° angle with respect to the surface of the cover segment 10. As shown in FIG. 32A, the bottom extension has a downward extending flange 281, which extends in a downward direction at essentially a 90° angle with respect to bottom extension 280. As shown in FIG. 32A, the downward extending flange 281 extends from the bottom extension 280 along the bottom extension 280. In addition, the support legs 230, 231 include a support leg downward extending flange 282 extending off and downward from each support leg 230, 231.

A plurality of stand offs 221, 222 are formed in each cover segment. The stand offs 221, 222 are formed as a pocket molded inwardly from the outer surface 3 of the cover segment 10 and as a result extend inwardly toward the support structure 1. The stand offs 221, 222 function as a contacting point between the cover and the outer surface of the support structure 1 being covered. As shown in FIG. 32A, middle stand offs 222 have a slightly different structure than side stand offs 221. The middle stand offs 222 have a flange 227 extending in respective directions depending on the position of the middle stand off 222 relative to the cover segment 10. For example, the middle stand off 222 in the center of the cover segment 10 has a flange 227 extending to the side, while the flange in the upper middle stand off 222 has a flange 227 extending in an upward direction. The flanges 227 are for packing and shipping the cover segments in a stacked position, which will be discussed in more detail below. The flanges 227 fit into and engage with an indentation 228 formed into each middle stand off 222. Accordingly, as the cover segments 10 are stacked for shipping, each flange 227 engages with corresponding indentation 228.

The side stand offs 221 have a stepped portion 223 formed into the pocket thereby forming a second pocket 225. This feature is also for packing and shipping the cover segments 10 in a stacked position and will be explained in more detail below. Upon stacking for shipping, the stepped side corner 224 fits into the pocket 225 in a nested position.

Similar to other embodiments explained above, the cover segment 10 of this embodiment includes lateral connectors 251 and 252. Upon assembly, the connector tab 251 fits inside and engages with the tab receiver 252 to form a mechanical connection. As shown in FIGS. 32A and 32B, the tab receivers 252 and tab connectors 251 are formed to extend outward with respect to the surface of the cover 3. As shown in FIG. 31, upon lateral connection of cover segments 10, only the tab receiver 252 is visible when viewing the cover 2 from the outside.

Figure 33A:
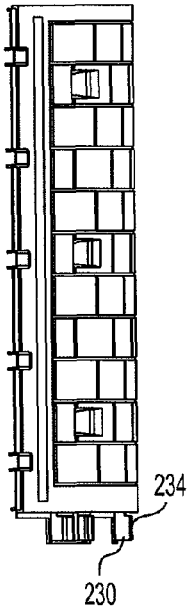
FIG. 33A is a perspective view of a side of a cover segment of an embodiment of the present invention.
Figure 33B:
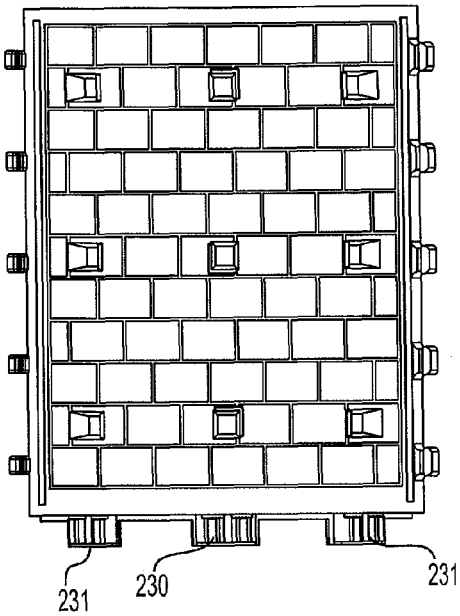
FIG. 33B is a perspective view of a cover segment of an embodiment of the present invention.
Figure 33C:
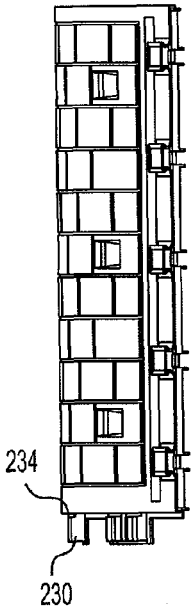
FIG. 33C is a perspective view of a side of a cover of an embodiment of the present invention.
Figure 33D:
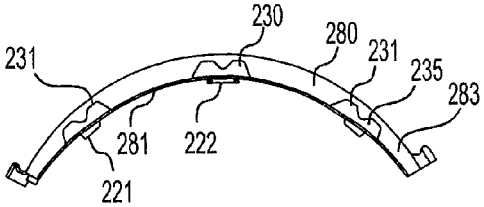
FIG. 33D is a perspective view of the bottom of a cover segment according to an embodiment of the present invention.

FIG. 33D shows a bottom perspective view of the cover segment 10. As shown in FIG. 33D, portions of the bottom extension 280 do not extend inward as far as other portions of the bottom extension 280. For example, a portion denoted at 283 in FIG. 33D, does not extend as far inward relative to the outer surface of the cover segment 10 as a middle portion of the bottom extension 280. Further, on the side support legs 231, the outer rib of the rib formation 233 is made to be smaller and not extend as far in the outward direction. In addition, as shown in FIGS. 33A and 33C, each support leg 230, 231 includes an indentation 234. Upon vertical connection, the edge of the middle groove 272 slides into and engages the indentation 234 of the middle support leg 230. Similarly, upon vertical connection, the edges of the side grooves 271 slide into and engage the indentations 234 of the side support legs 231, respectively. FIG. 33D also shows that the support legs 230, 231 are set back inwardly due to their formation off the bottom extension 280.

Figure 34A:
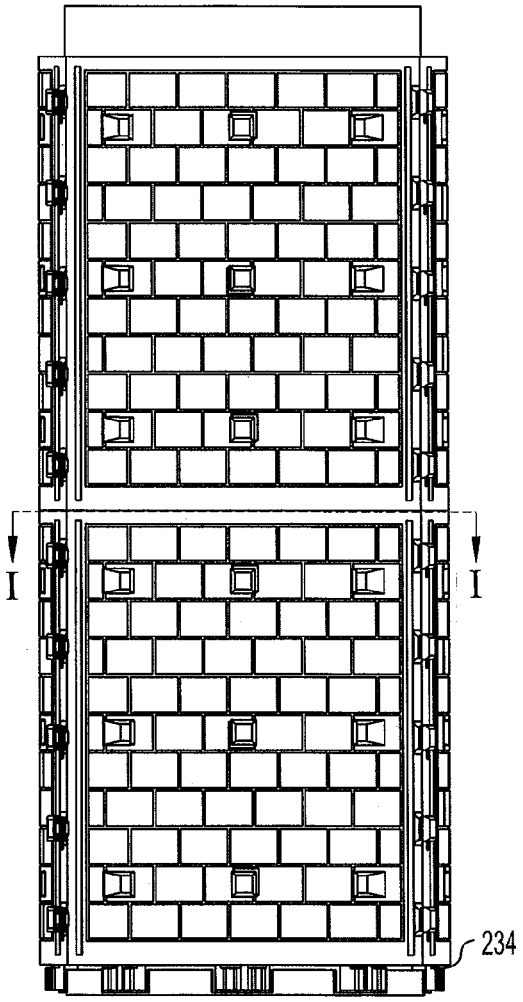
FIG. 34A is a plan view of cover segments connected to form a cover of the present invention.
Figure 34B:
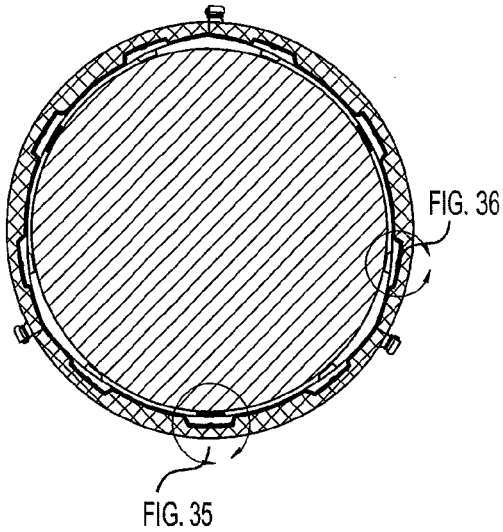
FIG. 34B is a cross section taken along line I-I of a cover shown in FIG. 34A.
Figure 35:
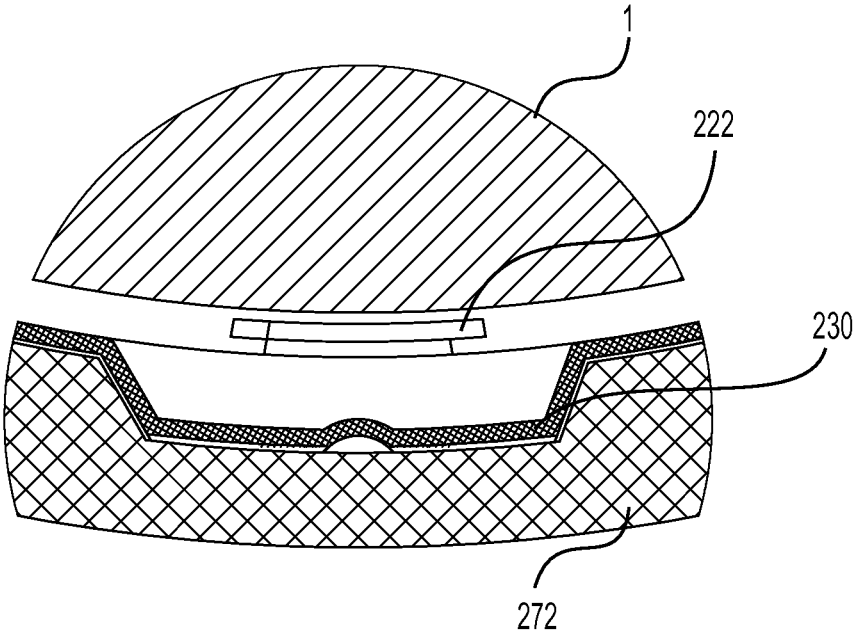
FIG. 35 is an enlarged partial sectional view of a vertical connection of cover segments.

FIG. 34B is cross section along the line I-I of a cover formed of cover segments 10 stacked in the vertical direction shown in FIG. 34A. FIG. 35 is a detailed view of the connection between the middle groove 272 of top interconnector 270 and middle support leg 230. Upon vertical connection of cover segments 10, the support legs 230, 231 slide into the corresponding grooves 271, 272 in the top interconnector 272. Accordingly, due to the set back formation of the support legs relative to outer surface of the cover 3 (shown in FIG. 33D), when vertically stacked, the support legs 230, 231 of the upper cover segment 10 are not seen from the outside.

Figure 36:
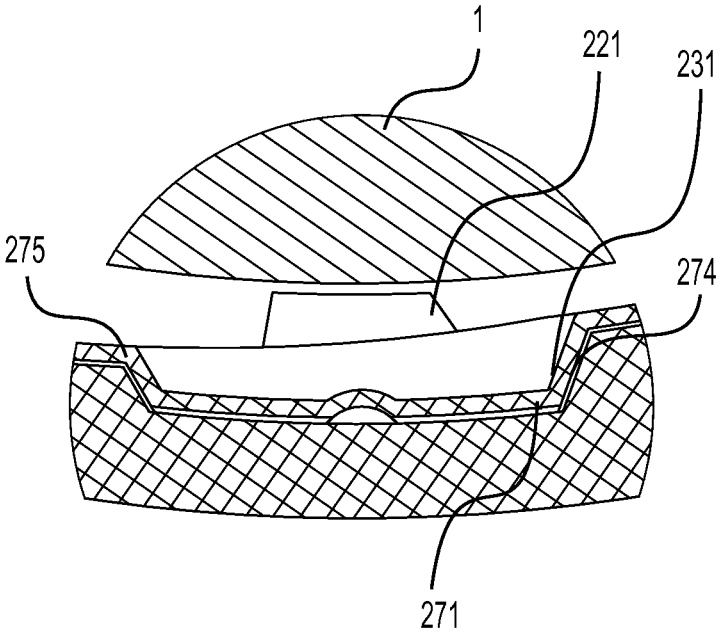
FIG. 36 is an enlarged partial sectional view of a vertical connection of cover segments.

FIG. 36 is a detailed view of the connection between a side groove 271 and a side support leg 231. The side groove 271 has two edges 274 and 275 and the side groove 271 is formed so that one edge 274 of the side groove 271 is formed deeper into top interconnector 270 than another edge 275 of the side groove 271. The support legs 230, 231 sliding into corresponding grooves 272, 271, respectively, also function as a guide for radial alignment of the cover segments 10 as they are connected in the vertical direction.

Figure 37A:
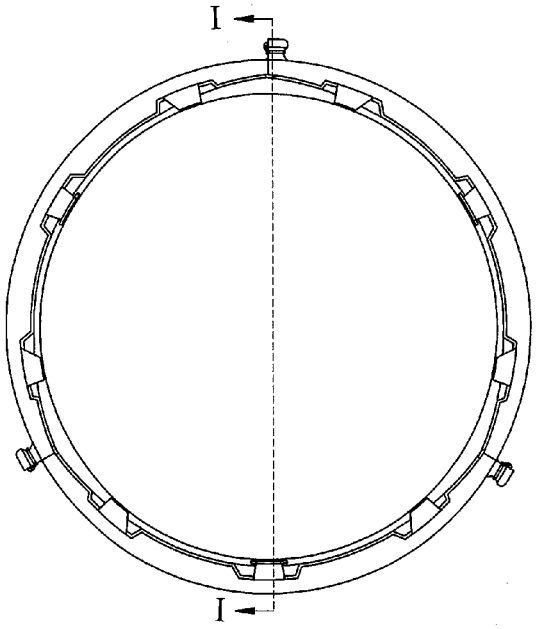
FIG. 37A is a top view of a cover of an embodiment of the present invention.
Figure 37B:
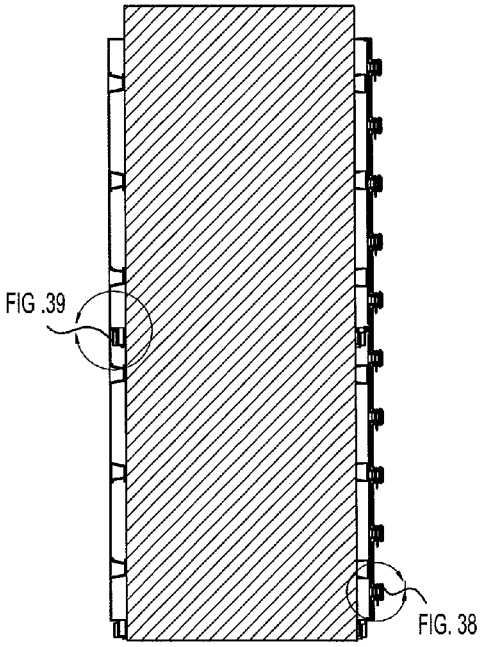
FIG. 37B is a cross section taken along line I-I of a top view of the cover of FIG. 37A.
Figure 38:
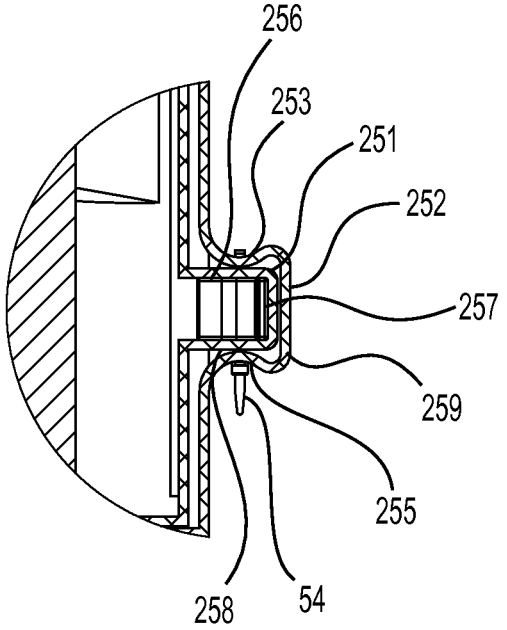
FIG. 38 is an enlarged partial sectional view of a vertical connection of cover segments.

FIG. 37B is a cross section taken along line I-I of a top view of the cover of an embodiment of the present invention shown in FIG. 37A. FIG. 38 is a detailed view of the lateral connector 250 showing the mechanical connection of connector tab 251 and tab receiver 252. Upon lateral connection of two cover segments, shown in the cross section view of FIG. 38, for example, the connector tab 251 fits into the tab receiver 252. As shown in FIG. 38, the top side 256 of the connector tab 251 abuts the lower surface of the top concave portion 253 of the tab receiver 252. The outward facing side 257 of the connector tab 251 abuts the inner surface of the outward facing side 259 of the tab receiver 252. Further, the bottom side 258 of the connector tab 251 abuts the upper surface of the bottom concave portion 255 of the tab receiver 252. A flexible fastener 54 is shown that is preferably a zip-type tie. The fastener 54 is placed around the tab receiver 252 and fastened to maintain the connection of the tab receiver 252 and connector tab 251. The top surface of the top concave portion 253 and bottom surface of bottom concave portion 255 of the tab receiver 252 guide the fastener 54 and provides for a notch-type area for the fastener 54 to be placed.

Figure 39:
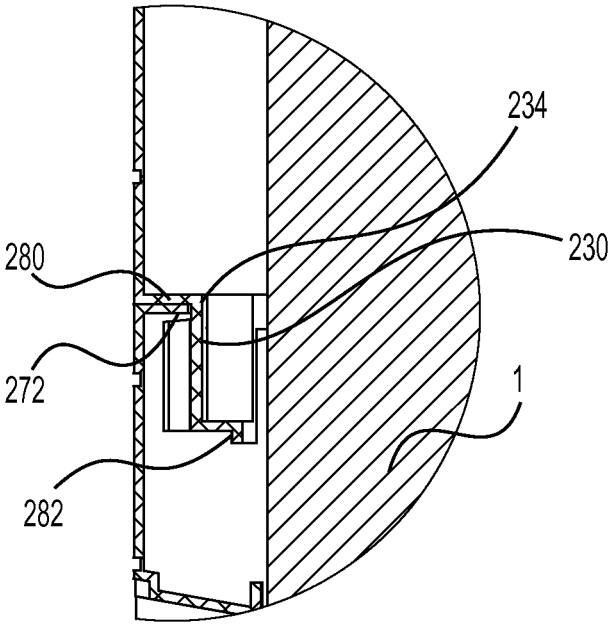
FIG. 39 is an enlarged partial sectional view of a lateral connection of cover segments.

FIG. 39 is an enlarged partial cross section view of a middle support leg 230 of an upper cover segment 10 engaging with the middle groove 272 of a lower cover segment 10, upon stacking cover segments vertically. As shown, the middle groove 272 abuts the bottom extension 280 forming a flush and continuous seam where the upper cover segments and the lower cover segments contact each other. Further, the middle groove 272 abuts and engages the surface of the support foot indentation 234 of the middle support leg 230. The indentation 234 have a corresponding shape so that the top interconnector 270 abuts and engages the indentation 234 in a flush manner.

Figure 40A:
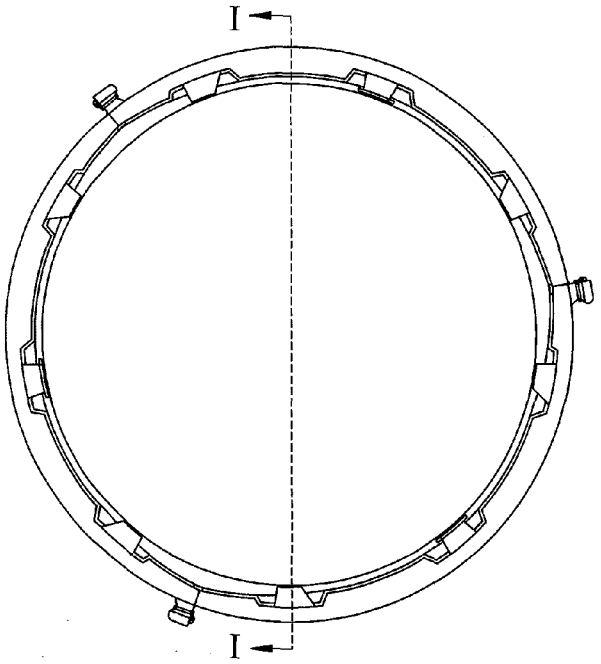
FIG. 40A is a top view of a cover of an embodiment of the present invention.
Figure 40B:
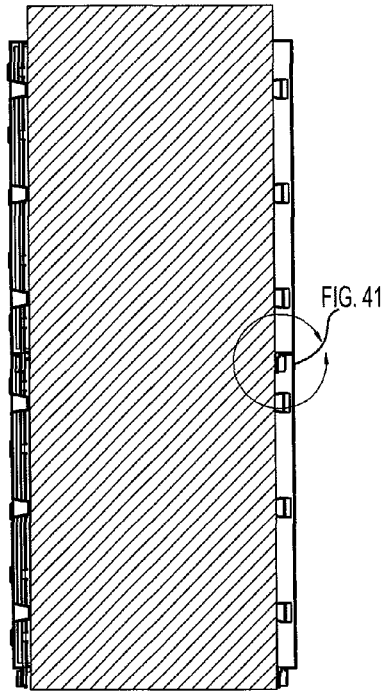
FIG. 40B is a cross section taken along line I-I of the cover shown in FIG. 40A.
Figure 41:
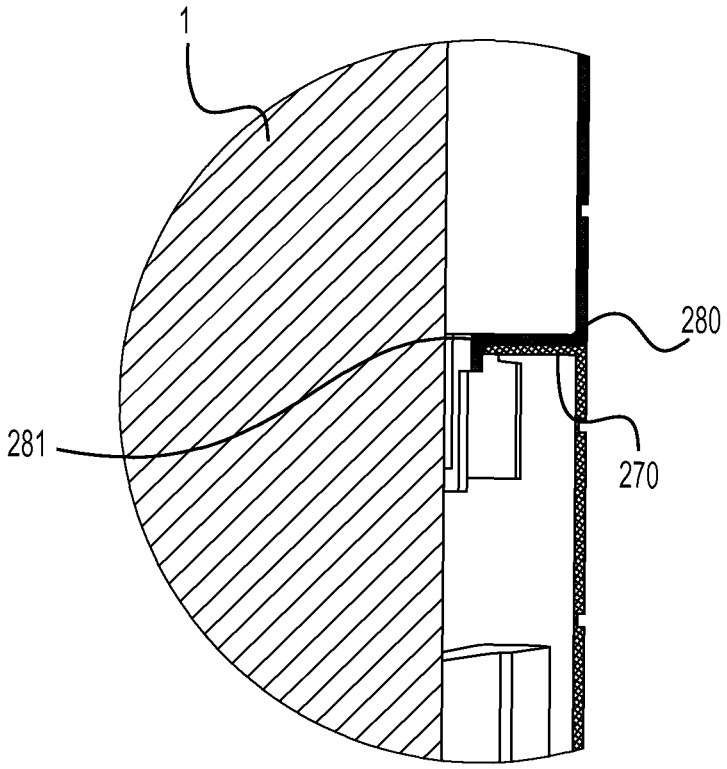
FIG. 41 is an enlarged partial sectional view of a vertical connection of cover segments.

FIG. 40B is a cross section taken along line I-I of a top view of the cover 2 shown in FIG. 40A. FIG. 41 is an enlarged partial cross section view showing top interconnector 270 abutting bottom extension 280. As described above, the abutment shown creates a seam around the circumference of the cover when the cover segments 10 are connected in a vertically and laterally. The top interconnector 270 abuts and contacts with the top interconnector 270 around the cover 2 in a flush and substantially even manner. As shown in FIG. 41, a downward extending flange extends downwards further than a thickness of the top interconnector 270. As mentioned above, the downward extending flange 281 extends in a downward direction at essentially a 90° angle with respect to bottom extension 280. The downward extending flange 281 prevents outside materials (e.g., snow, ice, dirt, chemicals, particulate) from getting between the cover 2 and the support column 1 at the horizontal seam.

Figure 42:
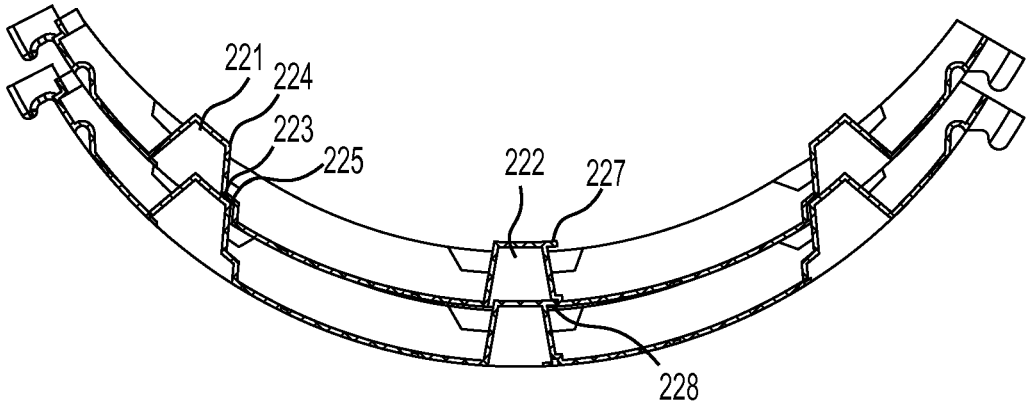
FIG. 42 is a perspective view showing the stacking and nesting features of an embodiment of the present invention.

FIG. 42 shows the stacking and nesting features of the cover segments 10 for delivering the cover segments 10. As noted above, the middle stand offs 222 have a flange member 227 that extends outwards from the pocket (stand off). As shown in FIG. 42, the flange member 227 of the middle stand off 222 fits into the indentation of another middle stand off 222 when arranged and oriented correctly. With respect to the side stand offs 221, each one has a stepped portion 223 thereby forming a smaller pocket 225. Upon stacking for shipping, the stepped side corner 224 fits into the pocket 225 when correctly arranged, thereby nesting the side stand off partially within another. Further, when stacked, as a result of the nesting features shown in FIG. 42, the top interconnector 270 and bottom extension 280 are prevented from being compacted by the cumulative weight of stacked cover segments 10. Therefore, the top interconnector 270 and bottom extension 280 retain their form while stacked so as not be bent or otherwise deformed by the force of adjacent cover segments in the stacked position.

Figure 43:
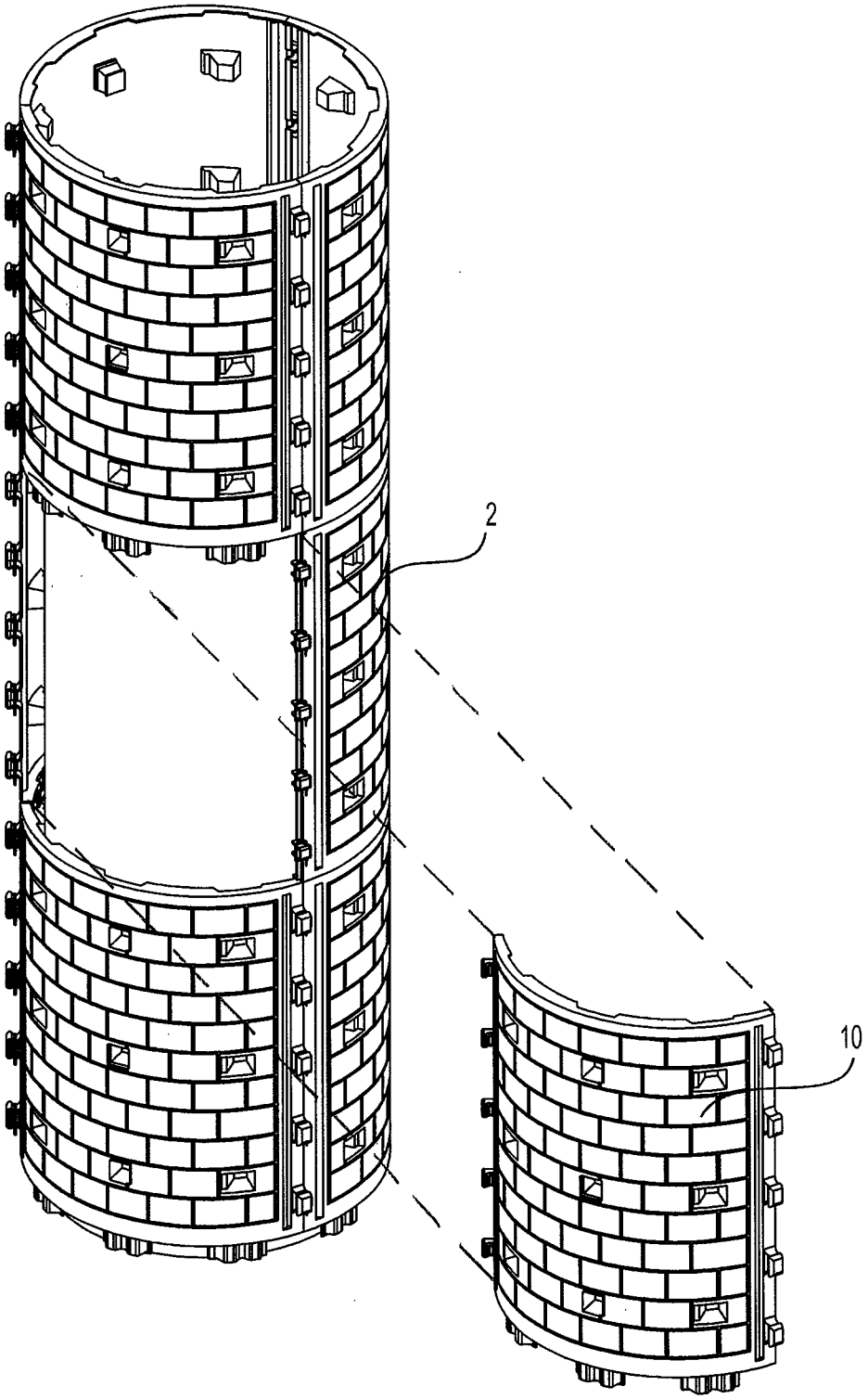
FIG. 43 is a plan view showing one cover segment of multiple cover segments removed while leaving the remaining cover segments installed.

An advantage of the present invention is that after installing the cover segments 10 to form a cover 2 around a support column 1, a worker is able to remove one cover segment 10 of the cover 2 and leave the remaining cover segments installed. FIG. 43 is an illustration of one cover segment 10 removed while the other cover segments 10 forming the cover remain installed. In other words, a worker can take one cover segment away from the cover to inspect the support structure 1, for example, and the remaining cover segments 10 of the cover 2 are left in a stable condition. One cover segment 10 may be uninstalled without uninstalling adjacent or any other cover segments 10 of the cover 2.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A cover segment of a modular cover in which two or more of said cover segments are connectable for surrounding a support structure, comprising:

the cover segment having a top edge, a bottom edge, opposing sides, an outer surface, and an inner surface, the inner surface facing a support structure when the two or more cover segments are connected;

at least one lateral connector disposed on the opposing sides of the cover segment in a lateral direction;

a top connecting member having a ledge extending inwardly substantially perpendicular to the inner surface of the cover segment and extending along the top edge of the cover segment;

a bottom connecting member having a ledge extending inwardly substantially perpendicular to the inner surface of the cover segment and extending along the bottom edge of the cover segment;

one or more pockets each disposed in the outer surface of the cover segment and open to the top edge of the cover segment and extending downward from the top edge;

one or more bottom flanges extending in a downward direction from the bottom edge of the cover segment; and a plurality of protrusions projecting inwardly from the outer surface of the cover segment toward a support structure;

wherein the at least one lateral connector of one of the two opposing sides of the cover segment is configured to connect to a corresponding at least one lateral connector disposed on a corresponding one of the opposing sides of a laterally adjacent cover segment when two or more of the cover segments are connected, wherein the top ledge of the top connecting member of one said cover segment is configured to correspond with the ledge of the bottom connecting member of a vertically adjacent said cover segment such that the ledge of the top connecting member and the ledge of the bottom connecting member abut one another when the two or more cover segments are connected, and wherein the one or more pockets of the cover segment are configured to accept corresponding ones of the one or more bottom flanges of the cover segment of a vertically adjacent said cover segment when the two or more cover segments are connected.

2. The cover segment of a modular cover surrounding a support structure according to claim 1, wherein the at least one lateral connector of one side of the cover segment has top and bottom concave surfaces, the at least one lateral connector of the opposite side of the cover segment has top and bottom concave surfaces and is configured to accept the at least one lateral connector on the one side of a cover segment, and at least one of the top concave surface and the bottom concave surface of the at least one lateral connector on the opposite side of the cover segment engage with a flexible fastener.

3. The cover segment of a modular cover surrounding a support structure according to claim 1, wherein the cover segment, the lateral connectors, the top connecting member, the bottom connecting member, the one or more pockets, and the one or more bottom flanges are all formed as one piece.

4. The cover segment of a modular cover surrounding a support structure according to claim 1, wherein the top connecting member has a plurality of C shaped channels disposed along the top connecting member, the bottom surface of each channel is a top surface of the top connecting member, wherein the bottom connecting member has a plurality of tongue members extending inward substantially perpendicular to the inner surface of the cover segment, and wherein the tongue members of the bottom connecting member of one said cover segment is configured to correspond with the channel of the top connecting member of a vertically adjacent said cover segment such that the tongue of the bottom connecting member engages with corresponding channels of the top connecting member when the two or more cover segments are connected.

5. A cover segment of a modular cover in which two or more cover segments are connectable for surrounding a support structure, comprising:

the cover segment having a top edge, a bottom edge, opposing sides, an outer surface, and an inner surface, the inner surface facing a support structure when two more cover segments are connected;

at least one lateral connector disposed on the opposing sides of the cover segment in lateral direction;

a top connecting member having a ledge extending inwardly substantially perpendicular to the inner surface of the cover segment and extending along the top edge of the cover segment;

a bottom connecting member having a ledge extending inward substantially perpendicular to the inner surface of the cover segment and extending along the bottom edge of the cover segment;

one or more bottom flanges each extending from the bottom connecting member downward substantially perpendicular to the bottom connecting member; and a plurality of protrusions projecting inwardly from the outer surface of the cover segment toward a support structure;

wherein the at least one lateral connector of one of the two opposing sides of the cover segment is configured to connect to a corresponding at least one lateral connector disposed on a corresponding one of the opposing sides of a laterally adjacent cover segment when two or more of the cover segments are connected, wherein the top connecting member has one or more notches disposed in the top connecting member, and wherein the one or more bottom flanges of one said cover segment is configured to correspond with the notches of the top connecting member of a vertically adjacent said cover segment such that the bottom flanges fit within the notches when the two or more cover segments are connected, and the top ledge of the top connecting member of one said cover segment is configured to correspond with the ledge of the bottom connecting member of a vertically adjacent said cover segment such that the ledge of the top connecting member and the ledge of the bottom connecting member abut one another when the two or more cover segments are connected.

6. The cover segment of a modular cover surrounding a support structure according to claim 5, wherein the cover segment is formed of high density polyethylene.

7. The cover segment of a modular cover surrounding a support structure according to claim 5, wherein each of the bottom flanges has a rib structure and the top surface of the rib structure and the bottom surface of the bottom connecting member form a channel.

8. The cover segment of a modular cover surrounding a support structure according to claim 5, wherein, the plurality of protrusions include one or more first protrusions and one or more second protrusions, wherein the first protrusions are formed vertically between the second protrusions, wherein the inner surface of the first protrusions each have a flange member extending in at least one of a lateral direction and a vertical direction, and wherein the second protrusions consist of cavities and at least one cavity is formed in a stepped manner having portions of the cavity deeper than other portions of the cavity.

9. The cover segment of a modular cover surrounding a support structure according to claim 5, wherein the cover segment, the lateral connectors, the top connecting member, the bottom connecting member, and the bottom flanges, are formed as one piece.

10. The cover segment of a modular cover surrounding a support structure according to claim 5, wherein the at least one lateral connector of one side of the cover segment has top and bottom concave surfaces, the at least one lateral connector of the opposite side of the has top and bottom concave surfaces and is configured to accept the at least one lateral connector of the one side of a cover segment, and at least one of the top concave surface and the bottom concave surface of the at least one lateral connector on the opposite side of the cover segment engage with a flexible fastener.

11. The cover segment of a modular cover surrounding a support structure according to claim 5, wherein the outer surface of each of the bottom flanges are set back in an inward direction from a plane of the outer surface of the cover segment.

12. The cover segment of a modular cover surrounding a support structure according to claim 5, wherein the at least one lateral connector of one side of the cover segment and the at least one lateral connector of the opposite side of the cover segment have first protruding members protruding outward from the outer surface of the cover segment, and each first protruding member has a notch extending vertically from the top of the first protruding member and a bump formed on an outer surface of the first protruding member.

13. The cover segment of a modular cover surrounding a support structure according to claim 1, wherein the cover segment is formed of high density polyethylene.

14. The cover segment of a modular cover surrounding a support structure according to claim 1, wherein the at least one lateral connector of one side of the cover segment and the at least one lateral connector of the opposite side of the cover segment have first protruding members protruding outward from the outer surface of the cover segment, and each first protruding member has a notch extending vertically from the top of the first protruding member and a bump formed on an outer surface of the first protruding members.

15. The cover segment of a modular cover surrounding a support structure according to claim 1, wherein the at least one lateral connector of one side of the cover segment and of the opposite side of the cover segment have first protruding members protruding outward from the outer surface of the cover segment, and each first protruding member has a notch extending vertically from the top of the first protruding member, wherein the outer surface of the notch engages with a flexible fastener.

16. The cover segment of a modular cover surrounding a support structure according to claim 1, wherein the at least one lateral connector of one side of the cover segment have a protrusion having a shape corresponding to a shape of the at least one lateral connector disposed on the opposite side of the cover segment, wherein the at least one lateral connector of the opposite side of the cover segment is hollow with an open face configured to accept a corresponding at least one lateral connector on the one side of the cover segment wherein, the shape of the at least one lateral connector of the one side of the cover segment and the shape of the at least one lateral connector of the opposite side of the cover segment are such that a mechanical connection is formed between the at least one lateral connector of the one side and the at least one lateral connector of the opposite side of a laterally adjacent cover segment when the lateral connectors are connected.

17. The cover segment of a modular cover surrounding a support structure according to claim 5, wherein the at least one lateral connector of one side of the cover segment and of the opposite side of the cover segment have first protruding members protruding outward from the outer surface of the cover segment, and each first protruding member has a notch extending vertically from the top of the first protruding member, wherein the outer surface of the notch engages with a flexible fastener.

18. The cover segment of a modular cover surrounding a support structure according to claim 5, wherein the at least one lateral connector of one side of the cover segment has a protrusion having a shape corresponding to a shape of the at least one lateral connector disposed on the opposite side of the cover segment, wherein the at least one lateral connector on the opposite side of the cover segment is hollow with an open face configured to accept a corresponding at least one lateral connector on the one side of the cover segment wherein, the shape of the at least one lateral connector of the one side of the cover segment and the shape of the at least one lateral connector of the opposite side of the cover segment are formed such that a mechanical connection is formed between the at least one lateral connector of the one side and the at least one lateral connector of the opposite side of a laterally adjacent cover segment when the lateral connectors are connected.

19. A modular cover for surrounding a support structure, comprising:

a plurality of cover segments, each having a top edge, a bottom edge, opposing sides, an outer surface, and an inner surface facing a support structure connected to form the cover surrounding a support structure, wherein each cover segment comprises:

at least one lateral connector disposed on the opposing sides of each cover segment in a lateral direction;

a top connecting member formed having a ledge extending inwardly substantially perpendicular to the inner surface of the cover segment and extending along a top edge of the cover segment;

a bottom connecting member having a ledge extending inwardly substantially perpendicular to the inner surface of the cover segment and extending along a bottom edge of the cover segment;

one or more bottom flanges each extending from the bottom connecting member downward substantially perpendicular to the bottom connecting member; and a plurality of protrusions projecting inwardly from the outer surface of the cover segment toward a support structure;

wherein the at least one lateral connector of one of the two opposing sides of a cover segment is connected to a corresponding at least one lateral connector disposed on a corresponding one of the opposing sides of a laterally adjacent cover segment, wherein the top connecting member has one or more notches disposed in the top connecting member, and wherein the one or more bottom flanges of a cover segment are configured to correspond with the notches of the top connecting member of a vertically adjacent said cover segment, and the bottom flanges fit within the corresponding notches of the top connecting member of a vertically adjacent cover segment, and wherein the top ledge of the top connecting member of one said cover segment is configured to correspond with the ledge of the bottom connecting member of a vertically adjacent said cover segment, and the ledge of the top connecting member and the ledge of the bottom connecting member abut one another.

20. The modular cover of claim 19, wherein the at least one lateral connector of one side of the cover segment has top and bottom concave surfaces, wherein the at least one lateral connector of the opposite side of the cover segment has top and bottom concave surfaces and are configured to accept the corresponding at least one lateral connector on the one side of a cover segment, and wherein a flexible fastener is used to secure the connection made between the lateral connectors of a cover segment and a laterally adjacent cover segment and the lateral connector on the opposite side of the cover segment engages with the flexible fastener.

21. The modular cover according to claim 19, wherein each of the bottom extending members has a rib structure and the top surface of the rib structure and the bottom surface of the bottom extending member form a channel, and wherein an edge of each notch of the top connecting member of the vertically adjacent cover segment engages with the corresponding channel of a cover segment.

22. The modular cover according to claim 19, wherein each of the cover segments are formed of high density polyethylene.

23. The modular cover according to claim 19, wherein the outer surface of each of the bottom flanges is set back in an inward direction from a plane of the outer surface of the cover segment.

24. The modular cover according to claim 19, wherein, the plurality of protrusions include one or more first protrusions and one or more second protrusions, wherein the first protrusions are formed vertically between the second protrusions, wherein the inner surface of the first protrusions each have a flange member extending in at least one of a lateral direction and a vertical direction, and wherein the second protrusions consist of cavities and at least one cavity is formed in a stepped manner having portions of the cavity deeper than other portions of the cavity.

25. The modular cover according to claim 19, wherein each cover segment, the lateral connectors, the top connecting member, the bottom connecting member, and the bottom flanges, are formed as one piece.

26. The modular cover according to claim 19, wherein the at least one lateral connector of one side of the cover segment and the at least one lateral connector of the opposite side of the cover segment have first protruding members protruding outward from the outer surface of the cover segment, and each first protruding member has a notch extending vertically from the top of the first protruding member and a bump formed on an outer surface of the first protruding member, and wherein when the at least one lateral connector of an opposing side of a cover segment is connected with the corresponding at least one lateral connector of an opposing side of a laterally adjacent cover segment, a c-shaped sleeve secures the connection of the at least one lateral connectors and open ends of the sleeve fit within the notches formed in each of the first protrusions and the bump of each first protrusion supports the sleeve.

27. The modular cover according to claim 19, wherein the at least one lateral connectors of one side of the cover segment and of the opposite side of the cover segment have first protruding members protruding outward from the outer surface of the cover segment, and each first protruding member has a notch extending vertically from the top of the first protruding member, wherein when the at least one lateral connector of an opposing side of a cover segment is connected with the corresponding at least one lateral connector of an opposing side of a laterally adjacent cover segment, a flexible fastener having an open middle secures the connection of the lateral connectors and the open middle of the flexible fastener engages with the surfaces of the notches of the first protruding members.

28. The modular cover according to claim 19, wherein the at least one lateral connector of one side of the cover segment has a protrusion having a shape corresponding to a shape of the at least one lateral connector disposed on the opposite side of the cover segment, wherein the at least one lateral connector of the opposite side of the cover segment is hollow with an open face configured to accept the at least one lateral connector on the one side of the cover segment wherein, the shape of the at least one lateral connector of the one side of the cover segment and the shape of the at least one lateral connector of the opposite side of the cover segment are such that a mechanical connection is formed between the at least one lateral connector of the one side and the at least one lateral connector of the opposite side of a laterally adjacent cover segment when the lateral connectors are connected.

* * * * *